US009222250B2

(12) United States Patent
Peterson et al.

(10) Patent No.: US 9,222,250 B2
(45) Date of Patent: Dec. 29, 2015

(54) FOLDING BUILDING

(71) Applicant: FOLDING HOLDINGS LLC, Woodinville, WA (US)

(72) Inventors: Elliot Peterson, Woodinville, WA (US); Douglas Peterson, Woodinville, WA (US)

(73) Assignee: Folding Holdings, LLC, Woodinville, WA (US)

( * ) Notice: Subject to any disclaimer, the term of this patent is extended or adjusted under 35 U.S.C. 154(b) by 0 days.

(21) Appl. No.: 14/520,146

(22) Filed: Oct. 21, 2014

(65) Prior Publication Data

US 2015/0121776 A1 May 7, 2015

Related U.S. Application Data

(60) Provisional application No. 61/894,172, filed on Oct. 22, 2013.

(51) Int. Cl.

| | |
|---|---|
| ***E04B 1/346*** | (2006.01) |
| ***E04B 1/343*** | (2006.01) |
| ***E04B 1/35*** | (2006.01) |
| ***E04B 1/41*** | (2006.01) |
| ***E04B 1/62*** | (2006.01) |
| ***E04B 1/76*** | (2006.01) |
| ***E04B 1/344*** | (2006.01) |
| *E04B 1/38* | (2006.01) |
| *E04B 1/08* | (2006.01) |

(52) U.S. Cl.

CPC ..... *E04B 1/34384* (2013.01); *E04B 1/3445* (2013.01); *E04B 1/34331* (2013.01); *E04B 1/34363* (2013.01); *E04B 1/3533* (2013.01); *E04B 1/40* (2013.01); *E04B 1/625* (2013.01); *E04B 1/762* (2013.01); *E04B 1/08* (2013.01); *E04B 2001/405* (2013.01); *E04B 2103/06* (2013.01)

(58) Field of Classification Search

CPC . E04B 1/24; E04B 1/3447; E04B 2001/2415; E04B 2001/2448; E04B 1/344; E04B 7/24; E04C 3/005; E04H 15/48

USPC ..... 52/71

See application file for complete search history.

(56) References Cited

U.S. PATENT DOCUMENTS

| | | | | |
|---|---|---|---|---|
| 2,053,135 | A * | 9/1936 | Dalton | 52/801.11 |
| 2,350,904 | A * | 6/1944 | King | 52/64 |
| 2,858,916 | A * | 11/1958 | Josephs | 52/377 |
| 3,184,012 | A * | 5/1965 | Ishimoto et al. | 52/93.1 |

(Continued)

*Primary Examiner* — Syed A Islam
*Assistant Examiner* — Joshua Ihezie
(74) *Attorney, Agent, or Firm* — Keith L. Jenkins, Registered Patent Attorney, LLC; Keith L. Jenkins

(57) ABSTRACT

Improved foldable buildings include an improved rafter plate with a fifth hole that can be used for lifting and as a safety anchor and also has angled corners to abut rafter plate stops newly installed on rafters. Rafters and columns have improved bracket plates, new cross brace flanges, and adaptations for L-shaped brackets that support new steel stud purlins and girts. Wall and roof panels now have a vapor barrier and improved insulation. Rafters are further improved by addition of lifting sleeves. Flashing is pre-cut to custom sizes to avoid cutting at the job site and now features steel gauge flashing with adhered closed cell foam rubber on the interior surface. For long ridge flashing, flashing pieces have interlocking ends. Improved methods of assembly are described.

23 Claims, 26 Drawing Sheets

(56) References Cited

U.S. PATENT DOCUMENTS

| | | | | | |
|---|---|---|---|---|---|
| 3,296,752 | A | * | 1/1967 | Philp | 52/70 |
| 3,774,356 | A | * | 11/1973 | Philp | 52/70 |
| 3,785,108 | A | * | 1/1974 | Satchell | 52/645 |
| 3,786,612 | A | * | 1/1974 | Baker | 403/295 |
| 3,940,892 | A | | 3/1976 | Lindbergh | |
| 3,968,618 | A | * | 7/1976 | Johnson | 52/745.14 |
| 3,971,185 | A | * | 7/1976 | Hendrich | 52/745.14 |
| 4,066,089 | A | * | 1/1978 | Rainwater | 135/151 |
| 4,078,341 | A | * | 3/1978 | Peterson | E04B 1/3447 52/71 |
| 4,170,852 | A | * | 10/1979 | Danis, Jr. | 52/71 |
| 4,219,982 | A | * | 9/1980 | Hart | 52/641 |
| 4,479,333 | A | * | 10/1984 | Hendrich | 52/70 |
| 4,773,192 | A | * | 9/1988 | Andrews | 52/93.1 |
| 5,069,238 | A | * | 12/1991 | Marks | 135/153 |
| 5,983,577 | A | * | 11/1999 | Hays | 52/79.1 |
| 6,035,582 | A | | 3/2000 | Pacific | |
| 6,519,900 | B1 | * | 2/2003 | Pierce | 52/66 |
| 6,681,786 | B2 | * | 1/2004 | Ju | 135/120.3 |
| 6,763,633 | B2 | * | 7/2004 | Cote | 52/71 |
| 7,500,592 | B1 | * | 3/2009 | Petricio Yaksic | 228/184 |
| 7,739,841 | B1 | * | 6/2010 | Puckett | 52/93.1 |
| 8,056,573 | B2 | * | 11/2011 | Panigot | 135/147 |
| 8,763,315 | B2 | * | 7/2014 | Hartman et al. | 52/79.5 |
| 8,973,332 | B2 | * | 3/2015 | Lee | 52/653.2 |

* cited by examiner

FOLDING BUILDING

RELATED APPLICATIONS

This application claims the benefit of U.S. provisional patent application Ser. No. 61/894,172 filed Oct. 22, 2013 to the same inventors.

TECHNICAL FIELD

This invention relates to providing an improved folding building. This invention more particularly relates to an improved folding building made of foldable prefabricated transverse four-panel hinged sections in which two panels are roof panels and two panels are wall panels. The sections are unfolded and placed end-to-end to form a building of any desired length. Unique end sections and end panels are used to close the ends of the building.

BACKGROUND

U.S. Pat. No. 4,078,341 to Peterson (hereinafter "Peterson") discloses a portable building comprised of one or more foldable, prefabricated transverse sections which, when erected and placed end to end, form the side walls and roof of the building. The roof panels in each section are joined with a single pivot on each side and wall sections are joined with a single pivot on each side. Each section can be folded into a stack that is four panels high with the wall panels on the outside of the stack, as previously disclosed in U.S. Pat. No. 3,774,356. Each panel is constructed of a steel channel frame (opening outward) with corrugated metal sheets on each side. Each panel may contain insulation, purlins or gifts, and openings for doors, skylights, windows, and the like. Peterson disclosed U-shaped brackets, welded into the web of channel frames and extending beyond the channel flanges, at predetermined locations, to assist in fastening sections together. Peterson disclosed roof braces and corner braces (roof to wall) made of detachable members with fastener holes in each end, on each side of each section. Front and rear end sections have a reversed channel on the outside end.

U.S. Pat. No. 4,170,852 to Danis, Jr. (hereinafter "Danis") discloses a folding building that has transverse four-panel sections that stack two panels high, with the wall panels on the underside. Danis also discloses using steel channel frames and corrugated metal sheeting. Danis' stacking allows a ridge brace to be loosely connected to a roof panel and so transported as part of the stack, rather than as a separate piece. Danis also uses a single hinge pin on each side of the roof panel coupling and in the wall couplings.

Folding buildings are portable, in that they can be deconstructed in a reverse process of erecting them, and reassembled in another location.

Demand for folding buildings remain high and the need to improve the economy, reliability, and strength of folding buildings for maintaining a competitive edge remains great. Significant economy can be achieved by improving the speed of erecting the folding building, by improving the safety of crews erecting the buildings, by improving thermal characteristics of the building, increasing the environmental loading and building span and improving stability in shipping, handling and erection.

Therefore, a need exists for improvements to folding buildings to improve the economy, reliability, capacity, and strength of folding buildings.

OBJECTS AND FEATURES OF THE INVENTION

A primary object and feature of the present invention is to overcome the above-mentioned problems and fulfill the above-mentioned needs.

Another object and feature of the present invention is to provide improvements that provide an improved hinge between roof panels.

Another object and feature of the present invention is to provide improvements that provide an improved hinge between roof panels wherein the hinge plate has an extension with an opening that may be used as a lift point during erection and as a fall arrest anchor point for workers on the roof after erection.

It is a further object and feature of the present invention to provide improvements that include plates with holes welded flange-to-flange on rafters and columns to prevent channels from interlocking during assembly and to control spacing, allow for lifting during unfolding, and for attachment of end walls.

It is a further object and feature of the present invention to provide improvements that include lifting sleeves welded between the toes of the rafter allow for removal of long shank hoist rings without requiring access to the roof.

It is a further object and feature of the present invention to provide improvements that include a secondary framing system comprised of structural light gauge steel studs with depth and gauge as required in a particular embodiment, including gauge metal cross bracing screwed to attachment plates welded to columns, with size and gauge as required in a particular embodiment.

It is a further object and feature of the present invention to provide improvements that include a continuous vapor barrier connected between panels with vapor barrier tape and sealing edge tabs to allow installation of a complete vapor barrier when panels are joined in the field.

It is a further object and feature of the present invention to provide improvements that include thermal tape at all exterior purlin and girt (secondary framing) faces to provide added thermal resistance between exterior cladding and steel framing.

It is a further object and feature of the present invention to provide improvements that include a system of bolt-in framed openings created as welded assemblies sized to bolt into rafters and columns for service ports, doors, windows, etc.

It is a further object and feature of the present invention to provide improvements that include base plate extensions at the bottom of each wall column (wall panel side frame) that serve as temporary caster couplings during lifting and as bolt-down plates during erection.

It is a further object and feature of the present invention to provide improvements that include custom flashing profiles designed to fit all panel to panel joint conditions, pre-cut flashing profiles with factory notched/opened hems for easy installation, and factory installed closed cell rubber backing to provide both a weather seal and thermal break between flashing and steel surface.

It is a further object and feature of the present invention to provide improvements that include improved erection sequences for buildings up to forty feet wide, buildings that are forty to one hundred feet wide, and for buildings where the walls are longer than the rafters.

It is a further object and feature of the present invention to provide improvements that include tension cables, a hinged truss system and shipping braces.

It is an additional primary object and feature of the present invention to provide such improvements that are efficient, inexpensive and handy. Other objects and features of this invention will become apparent with reference to the following descriptions.

SUMMARY OF THE INVENTION

Improvements to the original Peterson building include an improved roof hinge plate that has a fifth opening that serves as a lifting point during the erection sequence and as a fall arrest anchor point during roof flashing and skylight installation. Structural improvements within the panels include the use of light gauge steel studs for purlins and girts and cross-bracing using light gauge steel strap attached to tabs that extend from the web of the channel members, rather than the flanges. Peterson's U-shaped brackets are improved upon by replacing them with plates that extend transverse to and flush with the flanges of the column and rafter channels and are also used for lifting and attaching end panels. Lifting sleeves welded between the toes of the rafters provide improved lifting using long shank hoist rings during erection. Pre-cut flashing with custom-fit closed-cell foam insulation improves upon hand-stuffed joint insulation and flashing cut to fit on site. A shipping brace, incorporated in lieu of selected purlins and girts, add stability for shipping, handling and erection.

An improved folding building system including deployable folded four-panel sections, the panels having sides further including outward-facing, spaced-apart, aligned, and opposed steel channels for rafters and for columns, where the improvement includes: a rafter plate having five holes for joining first and second opposing rafters proximate a roof ridge, where: first and second holes of the five holes are proximate the top of the rafter plate and at opposing ends of the rafter plate and are configured to receive fasteners during transportation, to operate as hinges during deployment, and to subsequently receive fasteners during deployment; third and fourth holes of the five holes are proximate the bottom of the rafter plate and at the opposing ends of the rafter plate and are configured to receive fasteners during deployment; and a fifth hole of the five holes is proximate the top center of the raster plate and configured for lifting during deployment and for receiving safety lines during roof finishing; and first and second top corner side surfaces on the rafter plate configured to abut respective first and second rafter plate stops fixed to the first and second opposing rafters, when fully deployed. The improved folding building system, a further improvement including a rafter including: a plurality of bracket plates attached to opposing flange edges transversely across the channel of the rafter; and a hole in each the bracket plate aligned to a respective hole in a web of the channel for receiving fasteners for fastening adjacent the sections together. The improved folding building system, a further improvement including a rafter including: a plurality of sets of holes in the web for receiving fasteners for an equal or lesser plurality of L-brackets on an exterior surface of the web; first and second holes in the web proximate a roof ridge end of the rafter, where the first and second holes are configured to receive fasteners to the rafter plate; and a wall coupling extending from a roof eave end of the rafter and configured to assist in fixing the relationship between the rafter and a column during transportation, in providing a pivot between the rafter and the column during deployment, and in fixing a relationship between the rafter and the column when a predetermined angular relationship is established. The improved folding building system, a further improvement including a rafter including: at least one corner brace hole in the web proximate the roof eave end for attaching a corner brace; at least one ridge brace hole in the web proximate the roof ridge end for attaching a ridge brace; at least two cross brace flanges extending acutely from the exterior surface of the web for attaching at least two cross braces within one panel of the four panels. The improved folding building system, where the rafter includes a lifting sleeve between bored flanges of the channel and located proximate a middle of a length of the rafter. The improved folding building system, where the rafter includes a rafter plate stop for abutting one of the first and second edge surfaces of the rafter plate when fully deployed. The improved folding building system, a further improvement including a section including two roof panels of the four panels, each roof panel including: first and second opposed rafters forming the sides of the roof panel; a plurality of steel stud purlins coupled between the rafters and coupled to the opposed rafters by the L-shaped brackets; a corrugated metal sheet attached across exterior faces of the plurality of the steel stud purlins to form an exterior roof surface when deployed; at least two cross braces coupled to the at least two cross brace flanges and proximate to an indoor surface of the purlins; a vapor barrier between the purlins and the corrugated metal sheet; and thermal insulation between the vapor barrier and the corrugated metal sheet. The improved folding building system, a further improvement including a column, the column including: a plurality of bracket plates attached to opposing flange edges transversely across the channel of the column; and a hole in each bracket plate aligned to a respective hole in a web of the channel for receiving fasteners for fastening adjacent sections together. The improved folding building system, a further improvement including a column, the column including: a plurality of sets of holes in the web for receiving fasteners for a plurality of L-brackets on an exterior surface of the web; at least one hole in the web proximate the roof eave end for attaching a corner brace; at least two cross brace flanges extending acutely from the exterior surface of the web; and a base plate closing the bottom end of the column, where the base plate has an extension with holes for assisting in fastening a caster during deployment and for assisting in fastening the wall panel to a foundation. The improved folding building system a further improvement including a section including two wall panels of the four panels, each wall panel including: first and second opposed the columns forming the sides of the wall panel; a plurality of steel stud girts coupled between the columns and coupled to the columns by the L-shaped brackets; a first corrugated metal sheet attached across exterior faces of the plurality of the steel stud girts to form an exterior wall when deployed; at least two cross braces coupled to the at least two cross brace flanges and proximate to indoor surfaces of the girts; a vapor barrier between the girts and the first corrugated metal sheet; thermal insulation between the vapor barrier and the first corrugated metal sheet; and a second corrugated metal sheet attached across the interior faces of the plurality of the steel stud girts to form an interior wall when deployed. The improved folding building system, further including at least one shipping brace installed between first and second opposing columns of at least one wall panel. The improved folding building system further including first and second tension cables, each tension cable including: a turnbuckle having a first threaded attachment to a rigid attachment to at least one of a first column, a first rafter, and a plate attached to at least one of the first column and the first rafter; and a tensionable cable having a first cable end coupled to a second threaded attachment to the turnbuckle and a second end attached to at least one of a second column, a second rafter, and a plate attached to at least one of the second column and the second rafter on an opposed side of the building. The improved folding building system, further including a lattice span truss spanning the junction of the rafter and an attached column, and having at least three independent pieces that fold into the section during transport and storage and that deploy by unfolding during building erection, where each of the three pieces is deployed in turn and fastened to an adjacent piece. The improved folding building system, a further improvement including: a plurality of the sections deployed, aligned, and fastened panel-side-to-panel-side to form a shell having a continuous wall and roof; at least one end panel adapted to at least partially close an end of the shell; a plurality of flashing strips having a lesser plurality of predetermined lengths and shapes, where the flashing strips comprise gauge steel with adhered closed-cell foam and where ridge flashing strips of the plurality of flashing strips further comprise interconnecting ends. The improved folding building system, a further improvement including the at least one of the four-panel section and the at least one end panel having one of a door frame, a window frame, and a skylight framed with at least two of a purlin, a girt, a column, and a rafter.

An improved folding building system including deployable folded four-panel sections having sides further including outward facing steel channels for rafters and columns, where the improvement includes: a rafter plate having five holes for joining first and second opposing rafters proximate a roof ridge, where: first and second holes of the five holes are proximate the top of the rafter plate and at opposing ends of the rafter plate and are configured to receive fasteners during transportation, to operate as hinges during deployment, and to receive fasteners at completion of deployment; third and fourth holes of the five holes are proximate the bottom of the rafter plate and at opposing ends of the rafter plate and are configured to receive fasteners at completion of deployment; and a fifth hole of the five holes is proximate the top center of the raster plate and configured for lifting during deployment and for receiving safety lines during roof finishing; and first and second top corner side surfaces configured to abut respective first and second rafter plate stops fixed to the first and second opposing rafters, when deployed; each rafter of the first and second opposing rafter further including: a plurality of spaced apart bracket plates attached to opposing flange edges transversely across the channel of the rafter; and a hole in each bracket plate aligned to a respective hole in a web of the channel for receiving fasteners for fastening adjacent sections together. The improved folding building system, a further improvement including a rafter including: a plurality of bracket plates attached to opposing flange edges transversely across the channel of the rafter; a hole in each bracket plate aligned to a respective hole in a web of the channel for receiving fasteners for fastening adjacent sections together; a plurality of sets of holes in the web for receiving fasteners for an equal or lesser plurality of L-shaped brackets on an exterior surface of the web; first and second holes in the web proximate a roof ridge end of the rafter, where the first and second holes are configured to receive fasteners to the rafter plate; a wall coupling extending from a roof eave end of the rafter and configured to assist in fixing the relationship between the rafter and a column during transportation, to provide a pivot between the rafter and the column during deployment, and to subsequently assist in fixing the relationship between the rafter and the column during deployment; at least one corner brace hole in the web proximate the roof eave end for attaching a corner brace; at least one ridge brace hole in the web proximate the roof ridge end for attaching a ridge brace; at least two cross brace flanges extending acutely from the exterior surface of the web for attaching at least two cross braces within each panel of the four panels; and a lifting sleeve between bored flanges of the channel and located proximate a middle of a length of the rafter. The improved folding building system, a further improvement including two roof panels of the four panels, each roof panel including: first and second opposed the rafters forming the sides of the roof panel; a plurality of steel stud purlins coupled between the rafters and coupled to the opposed rafters by the L-shaped brackets; a corrugated metal sheet attached across exterior surfaces of the plurality of the steel stud purlins to form an exterior roof surface when deployed; at least two cross braces coupled to the at least two cross brace flanges and proximate to an indoor surface of the purlins; a vapor barrier between the purlins and the corrugated metal sheet; and thermal insulation between the vapor barrier and the corrugated metal sheet. The improved folding building system, a further improvement including a column, the column including: a plurality of bracket plates attached to opposing flange edges transversely across the channel of the column; a hole in each bracket plate aligned to a respective hole in a web of the channel for receiving fasteners for fastening adjacent sections together; a plurality of sets of holes in the web for receiving fasteners for a plurality of L-shaped brackets on an exterior surface of the web; at least one hole in the web proximate the roof eave end for attaching a corner brace; at least two cross brace flanges extending acutely from the exterior surface of the web; and a base plate closing the bottom end of the column, where the base plate has an extension with holes for assisting in fastening a caster during deployment and for subsequently assisting in fastening the wall panel to a foundation. The improved folding building system, a further improvement including two wall panels of the four panels, each wall panel including: first and second opposed columns forming the sides of the wall panel; a plurality of steel stud girts coupled between the columns and coupled to the columns by the L-shaped brackets; a first corrugated metal sheet attached across exterior faces of the plurality of the steel stud girts to form an exterior wall when deployed; at least two cross braces coupled to the at least two cross brace flanges and proximate to an indoor surface of the girts; a vapor barrier between the girts and the first corrugated metal sheet; thermal insulation between the vapor barrier and the first corrugated metal sheet; and a second corrugated metal sheet attached across the first and second opposed columns to form an interior wall when deployed. The improved folding building system, a further improvement including: a plurality of the sections deployed, aligned, and fastened panel-side-to-panel-side to form a shell having a continuous wall and roof; at least one end panel adapted to at least partially close an end of the shell; a plurality of flashing strips having a lesser plurality of predetermined lengths and shapes, where the flashing strips comprise gauge steel with adhered closed-cell foam rubber and where ridge flashing strips of the plurality of flashing strips further comprise interlocking ends.

An improved folding building system including deployable folded four-panel sections, the panels having opposing sides further including outward-facing spaced-apart, aligned, and opposed steel channels for rafters and for columns and where the rafters are longer than the columns, where the improvement includes a method of deployment further including the steps of: delivering a folded and fastened together four-panel section to an assembly area having a foundation, where the stack rests on a first wall panel; unfastening shipping fasteners from the section; unfolding the stack about pivot points between first and second loosely fastened ridge plates and first and second roof panels, where the unfolded stack rests on the first and a second wall panel; lifting the first and second adjacent roof panels via lifting points in the first and second ridge plates, until a desired roof angle is obtained; fastening first and second ridge braces between the first and second roof panels; installing first and second casters on first and second base plate extensions, respectively, on each bottom edge of the two wall panels of the four-panel section; additionally lifting the first and second roof panels to a position in which first, second, third and fourth corner braces can be initially and pivotably installed; installing the corner braces; further lifting the section until the wall panels are vertical; removing the casters; fixing the cross braces in place; aligning the first wall panel to a foundation; attaching the first wall panel to the foundation via the first and second base plate extensions of the first wall panel; relaxing lift; attaching the second wall panel to the foundation via the first and second base plate extensions of the second wall panel; complete ridge plate fastening; repeating steps a-v to deploy a plurality of the sections; fastening the plurality of sections together along panel sides to form a shell with continuous walls and roof; attaching at least one end panel to at least partially close off at least one end of the shell; flashing seams between the panels using a gauge steel flashing with adhered closed-cell foam rubber of custom lengths.

An improved folding building system including deployable stacked four-panel sections, the panels having opposing sides further including outward-facing, spaced-apart, aligned, and opposed steel channels for rafters and for columns and where the columns are longer than the rafters and where the improvement includes a method of deployment further including the steps of: delivering the stacked four-panel section, fastened together with shipping fasteners, to an assembly area having a foundation, and unfastening shipping fasteners from first and second wall panels and first and second roof panels of the four-panel section; disposing the first roof panel on the foundation and aligning the second roof panel to the first roof panel; supporting the first and second roof panels in an elevated and linearly aligned position; attaching a first five-hole rafter plate to a ridge end of the first rafter of the first roof panel using one fastener through a top, first-side bore in the first rafter plate; attaching a second five-hole rafter plate to a ridge end of the second rafter of the first roof panel using one fastener through a top, first-side bore in the second rafter plate; pivotably attaching the first and second rafter plates to respective first and second rafters of the second roof panel; linearly aligning the first and second wall panels to the first and second roof panels, respectively; aligning first and second eave-end pivotable rafter coupling portions of the first and second roof panels to first and second top-end pivotable column coupling portions, respectively, of the first and second wall panels and installing four pivot fasteners through the four coupling portions, respectively, to form the first and second roof-to-wall couplings, respectively; attaching first and second casters to first and second base plate extensions of each the first and second wall panels; attaching first and second hoisting bars via cables to first and second swivel hoist rings installed proximate the top end of the first and second columns, respectively, of each of the first and second wall panels; lifting the first and second wall panels until a predetermined corner angle between the first wall panel and the first roof panel is achieved and the predetermined angle between the second wall panel and the second roof panel is achieved; installing first and second corner braces between the first wall panel and the first roof panel to maintain the predetermined angle; installing third and fourth corner braces between the second wall panel and the second roof panel to maintain the predetermined angle; disconnect the first and second hoisting bars and the swivel hoist rings; attach a hoisting bar via four cables to four respective long shank hoist rings in four respective lifting sleeves in four respective the rafters; lifting the section via the hoisting bar until a predetermined roof ridge angle is achieved; fastening a first ridge brace between the first pivotably coupled pair of rafters to assist in maintaining the predetermined roof ridge angle; fastening a second ridge brace between the second pivotably coupled pair of rafters to assist in maintaining the predetermined roof ridge angle; installing additional fasteners to secure the rafter plates to the rafters, and tightening all rafter plate fasteners; removing the casters; orienting the section on the foundation and securing the section to the foundation via fasteners through the base plate extensions; repeating steps a-v for at least one additional the sections; aligning and fastening together a plurality of the sections by fastening adjacent the rafters and adjacent the columns to form a shell; installing at least one end panel to close off at least a portion of at least one end of the shell; flashing seams between the panels using a gauge steel flashing with adhered closed-cell foam rubber.

BRIEF DESCRIPTION OF THE DRAWINGS

The present invention will hereinafter be described in conjunction with the following drawing figures, wherein like numerals denote like elements.

DETAILED DESCRIPTION OF THE PRESENT INVENTION

Figure 1:
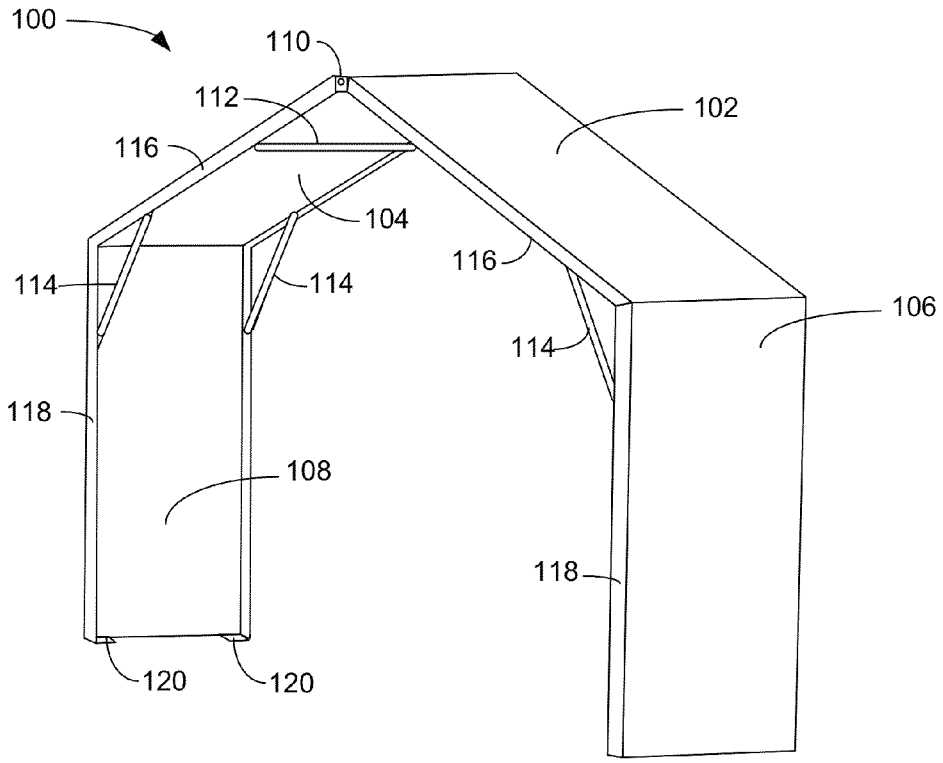
FIG. 1 is a front perspective view illustrating a first exemplary embodiment of a section of an exemplary improved folding building system, according to a preferred embodiment of the present invention.

FIG. 1 is a perspective view illustrating a first exemplary embodiment of a section 100 of an exemplary improved folding building system, according to a preferred embodiment of the present invention. Each section 100 includes four panels 102, 104, 106, and 108. Each panel 102, 104, 106, and 108 has steel channels for rafters 116, one on each side of each roof panel 102 and 104 or columns 118, one on each side of each wall panel 106 and 108. Rafters 116 are joined by purlins 502 (see FIGS. 5 and 7; the reference 502 will be used for girts and purlins) and columns 118 are joined by girts 502, which are preferably steel studs. In addition, opposed rafters 116 are joined by cross braces 612, 616, 642, and 644 (See FIG. 6A) and opposed columns 118 are joined by cross braces 612, 616, 642, and 644 (See FIG. 6A). Rafters 116 support exterior corrugated metal sheets similar to 602 in FIG. 7 and columns 118 support exterior and interior corrugated metal sheets 602 and 604 (see FIGS. 6B-7). Girts 502 support exterior corrugated metal sheeting 602 and interior corrugated metal sheeting 604. Purlins 502 support exterior corrugated metal sheeting 602, and interior corrugated metal sheeting 604.

Roof panels 102 and 104 are pivotably connected via rafter plates 110 (one on each side of section 100) during erection and are secured in place with the assistance of rafter plates 110 during operation. Ridge braces 112 (one on each side) also assist in securing roof panels 102 and 104 in place. Roof panel 102 is pivotably connected to wall panel 106 during erection and secured at a fixed angle during operation. Corner braces 114 assist in maintaining the fixed angle relationship between roof panel 102 and wall panel 106. Roof panel 104 is pivotably connected to wall panel 108 during erection and secured at a fixed angle during operation. Corner braces 114 assist in maintaining the fixed angle relationship between roof panel 104 and wall panel 108. Base plates 1002 (see FIG. 10) with extensions 120 are welded to the bottoms of columns 118 and have a perforated extension 120 (see FIGS. 10, 17 and 18) that serves to support casters 1802 (see FIG. 18) during erection and serves to receive anchors 1704 (see FIG. 17) for securing the section 110 to a concrete, wood, or other similar pad 2050 (see FIG. 20I). Multiple sections 100 are fastened side by side to form a foldable building 2100 (see FIGS. 21-23) of any desired length, to which end panels 2202, 2204, 2206, 2302, and 2306 (see FIG. 23) are added to complete the enclosure. The improved foldable building 2100 can be unfastened from the pad 2050 (see FIG. 20I), deconstructed, transported, and reconstructed at a new location.

Figure 2:
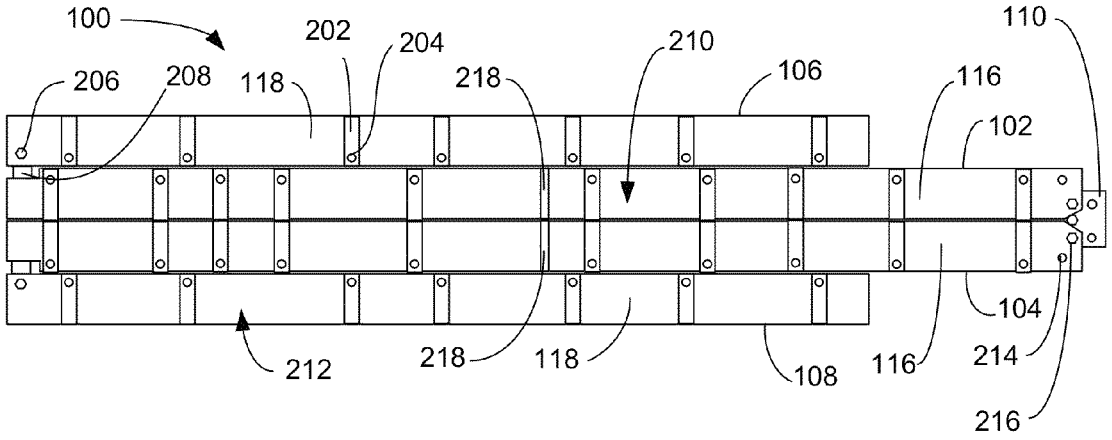
FIG. 2 is a side elevation view illustrating the first exemplary embodiment of a section of the exemplary improved folding building system of FIG. 1, according to a preferred embodiment of the present invention.

FIG. 2 is a side elevation view illustrating the first exemplary embodiment of a section 100 of the exemplary improved folding building system of FIG. 1, according to a preferred embodiment of the present invention. Section 100 is shown in a folded configuration, or stack, for transport and storage. Wall panels 106 and 108 are at the top and bottom of the stack, respectively, and the roof panels 102 and 104 are in the middle. Rafter plate 110 is pivotably connected to roof panels 102 and 104 by loosened bolts 216. Bolt holes 214 (one of two labeled) are used to secure the rafter plate 110 in place during operation. The rafters 102 and 104 and columns 106 and 108 are shown with the open faces of the channels facing the viewer. The surface 210 (one of two labeled) of the web 302 (see FIG. 3) of the rafters 116 can be seen as can the surface 212 (one of two labeled) of the web 302 (see FIG. 6) of the columns 118. Lifting sleeves 218 receive installation of long-shank hoisting rings for lifting roof panels 102 and 104 during erection.

Bracket plates 202 having holes 204 (one of thirty-four labeled) extend between the flanges 304 (see FIG. 3) of each channel and are oriented such that holes 204 will be in the interior of the assembled column 118 or rafter 116 when constructed. While various arrangements of bracket plates 202 may be made for various embodiments, all bracket plates 202 on columns 118 must be in the same positions and all bracket plates 202 on rafters 116 must be in the same position. The holes 204 are fastener openings for coupling adjacent sections 100 together.

Wall coupling 208 (one of two labeled) is fixed to rafter 116 and may pivot around bolt 206 when bolt 206 is loosened.

During transport, the panels 102, 104, 106, and 108 are releasably fastened together to make a secure load. For non-limiting example, the panels 102, 104, 106, and 108 may be wired or banded together. Flange holes 902 (see FIG. 9) and 1004 (see FIG. 10) provide a means for receiving fasteners for fastening sections together for transport or storage.

Figure 3:
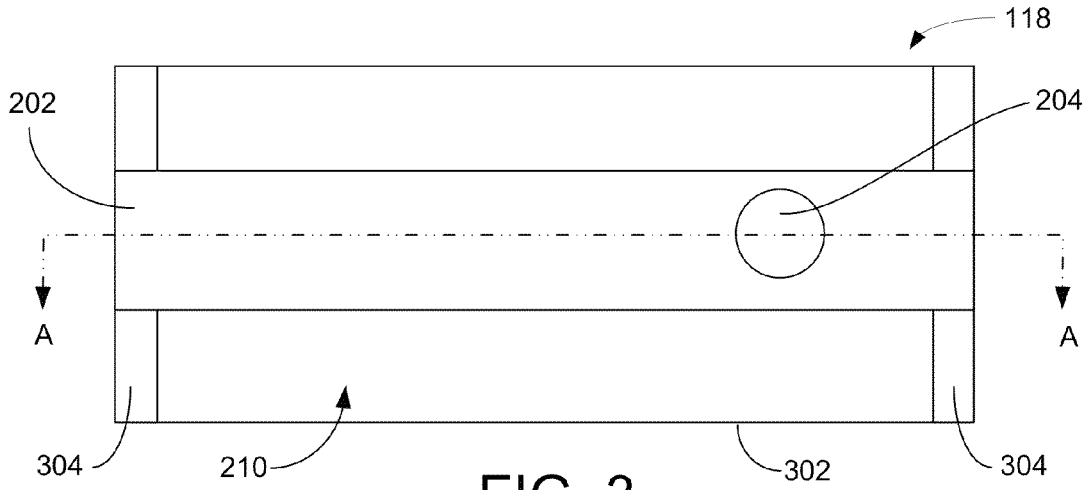
FIG. 3 is a top plan view illustrating a detail of the first exemplary embodiment of the section of the exemplary improved folding building system of FIG. 1 and defining cross section AA, according to a preferred embodiment of the present invention.

FIG. 3 is a top plan view illustrating a detail of the first exemplary embodiment of the section 100 of the exemplary improved folding building system of FIG. 1 and defining cross section AA, according to a preferred embodiment of the present invention. A portion of a rafter 116 is shown with outer surface 210 of web 302 and flanges 304. A bracket plate 202 is welded across the flanges 304 and has hole 204. The bracket plate 202 and hole 204 is the same for columns 118. The size and strength of bracket plates 202 may be adapted responsive to the engineering requirements for the particular building. The top surface of flange 304 is shown as flat, but the invention is not so limited. Any shape of the top surface of flange 304 that can function to accept welding of bracket plates 202 is within the scope of the present invention.

Figure 4:
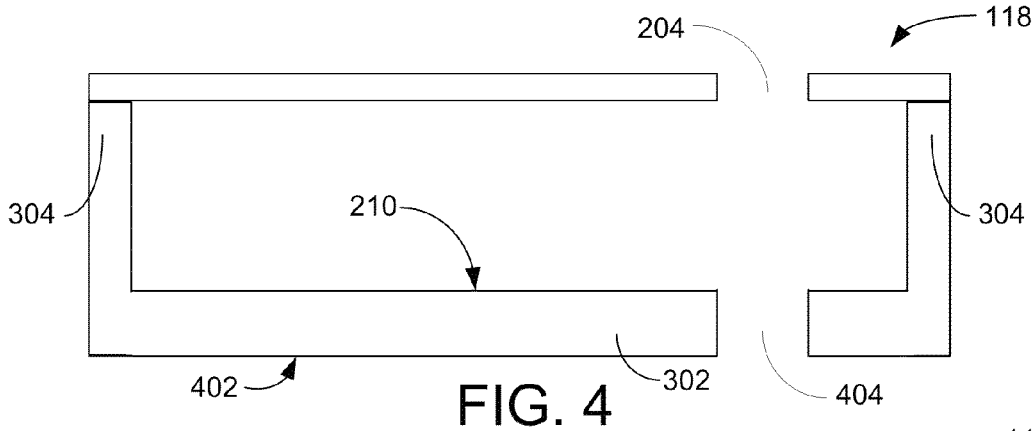
FIG. 4 is a cross-sectional view through cross section AA illustrating a detail of the exemplary embodiment of the section of the exemplary improved folding building system of FIG. 1, according to a preferred embodiment of the present invention.

FIG. 4 is a cross-sectional view through cross section AA illustrating a detail of the exemplary embodiment of the section 100 of the exemplary improved folding building system of FIG. 1, according to a preferred embodiment of the present invention. Hole 204 is aligned with hole 404 in web 302 to receive a fastener, such as a bolt 702 (see FIG. 7), through the rafter 116. Inner (relative to the roof panel 102 or 104) surface 402 of web 302 is shown. The bracket plate 202, hole 204, and hole 404 may be the same for columns 118.

Figure 5:
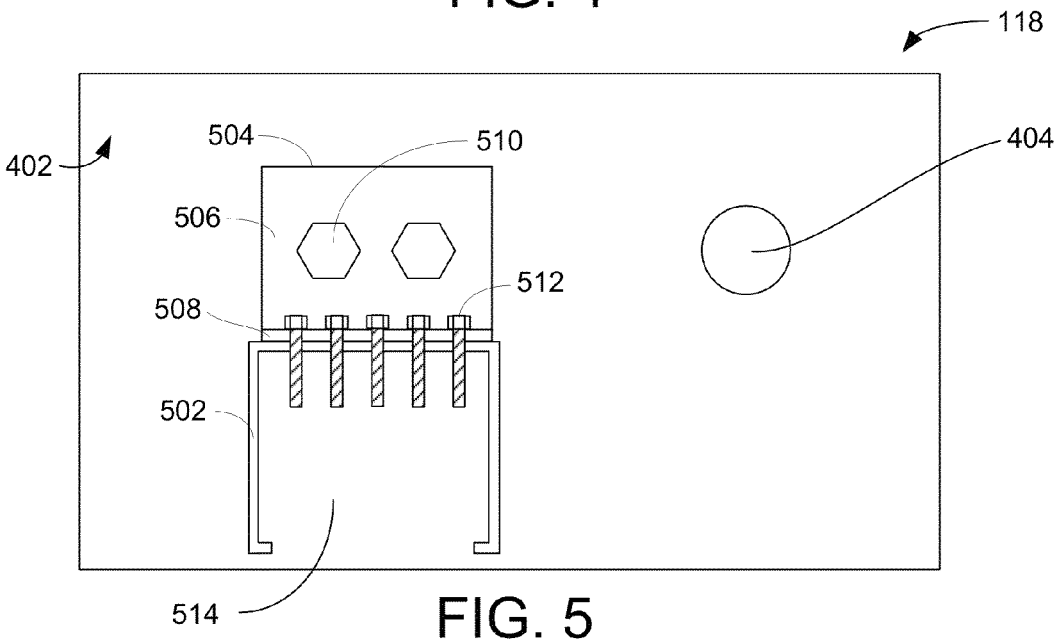
FIG. 5 is a side elevation view illustrating a detail of the exemplary embodiment of the section of the exemplary improved folding building system of FIG. 1, according to a preferred embodiment of the present invention.

FIG. 5 is a side plan view illustrating a detail of the exemplary embodiment of the section 100 of the exemplary improved folding building system of FIG. 1, according to a preferred embodiment of the present invention. A portion of the inner surface 402 of a rafter 116 is shown with an L-shaped bracket 504 attached to the rafter 116 by two bolts 510 (one of two labeled) through vertical bracket portion 506. L-shaped bracket 504 has a horizontal portion 508 to which purlin 502 is fastened with fastener 512 (one of five labeled). The opposing rafter 116 in panel 102 or 104 has a similar L-shaped bracket 504 aligned to receive the purlin 502 in the same way. Purlin 502 is preferably a commercial-off-the-shelf (COTS) steel stud. The same L-shaped brackets 504 are used to fasten girts 502 between columns 118. Hole 404 is offset from the centerline of the rafter 116, as will be discussed further below. Multiple purlins 502 are installed along each rafter 116 and multiple girts are installed along each column 118. The construction of the panels 102, 104, 106, and 108 is done in a factory and not in the field. In a particular embodiment, the space 514 within purlin 502 may receive a top portion of a block of insulation that rests on the top of the purlin 502 below. In a particular embodiment, a purline or girst may be replaced with a shipping brace.

Figure 6A:
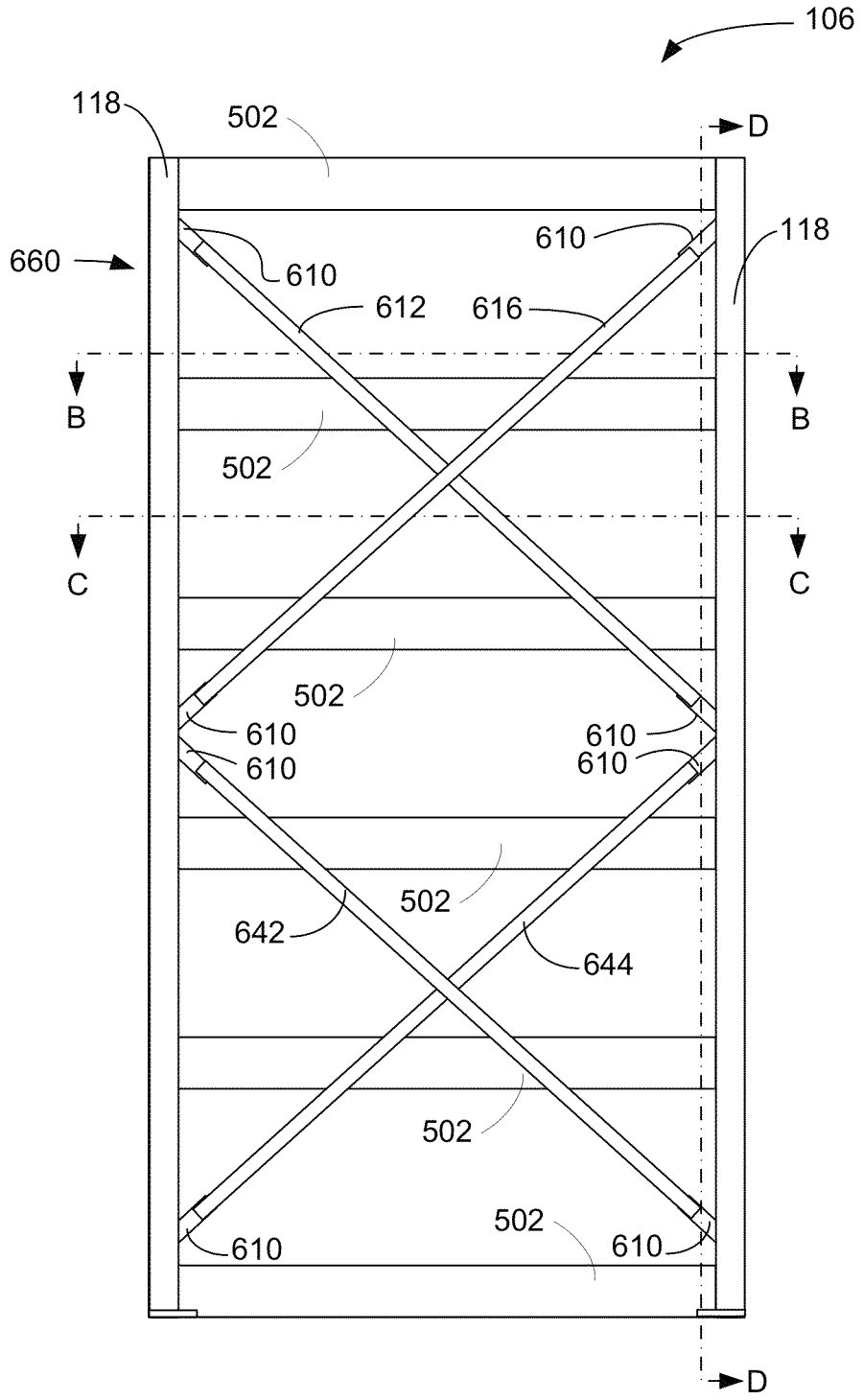
FIG. 6A is a rear elevation view illustrating an exemplary embodiment of a structural frame of an exemplary wall panel of the exemplary section of the exemplary improved folding building system of FIG. 1 and defining cross sections BB, CC, and DD, according to a preferred embodiment of the present invention.

FIG. 6A is a rear elevation view illustrating an exemplary embodiment of a structural frame 660 of an exemplary wall panel 106 of the exemplary section 100 of the exemplary improved folding building system of FIG. 1 and defining cross sections BB, CC, and DD, according to a preferred embodiment of the present invention. Girts 502 are shown in slightly exaggerated scale for simplicity of FIG. 6D. Frame 660 includes opposed columns 118 that are spaced apart by attached purlins 502. Cross brace tabs 610 are welded to columns 118 and support cross braces 612, 616, 642, and 644, which are thin steel strips that act primarily in tension. Preferably, cross braces 612, 616, 642, and 644 are attached to cross brace tabs 610 with fasteners 614 (see FIG. 6B), exemplified in the illustration as bolts. In addition steps of constructing the wall panel 106 from frame 660, thermal break tape (not shown) will be applied to the front sides of the girts 502 and a vapor barrier 618 (see FIGS. 6B-6E) will be added to the front of the frame 660, supported by the girts 502 and cross braces 612, 616, 642, and 644. Insulation 626 (see FIG. 6B-6D) will then be added on the vapor barrier 618 between the girts 502, and corrugated sheet metal 602 will be secured to the front side of the girts 502. Finally, corrugated sheet metal 604 (see FIG. 6B) will be secured to the rear side of the girts 502.

Cross section BB is made without insulation 626 above the girt 502 immediately below to show how girts 502 are attached to columns 118, as more fully described in regard to FIG. 6B. Cross section CC is made with insulation 626 above the girt 502 immediately below, as more fully described in regard to FIG. 6C. Cross section DD is made with the insulation 626 fully in place, as more fully described in regard to FIG. 6D.

Figure 6B:
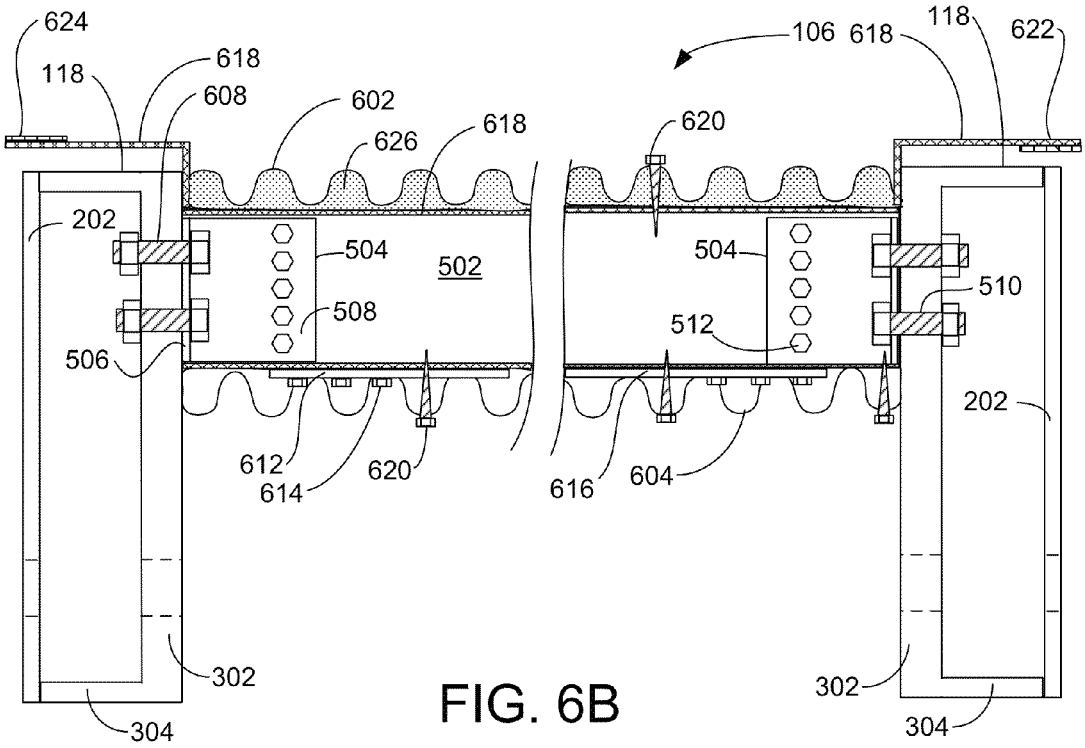
FIG. 6B is a top transverse cross-sectional view from cross-section BB of FIG. 6A illustrating an exemplary embodiment of a wall panel of the exemplary section of the exemplary improved folding building system of FIG. 1, according to a preferred embodiment of the present invention.

FIG. 6B is a top transverse cross-sectional view from cross-section BB of FIG. 6A illustrating an exemplary embodiment of a wall panel 106 of the exemplary section 100 of the exemplary improved folding building system of FIG. 1, according to a preferred embodiment of the present invention. Columns 118 support girt 502 with L-shaped brackets 504. Bolt holes 608 (one of four labeled) receive bolts 510 (one of four labeled) to fasten L-shaped brackets 504 to columns 118. Columns 118 also support exterior corrugated metal sheet 602. Girts 502 also support exterior corrugated metal sheet 602 via sheet metal screws 620 (two of four labeled). Continuous vapor barrier 618 covers the entire external face of the wall panel 106, wrapping conformally over all but the bottom girts' 502 and purlins' 502 top, exterior, and bottom surfaces. On the exterior surfaces of the girts 502 and purlins 502, a thermal break tape (not shown) is applied to assist in insulating the girt 502 or purlin 502 from the vapor barrier 618 and from the corrugated metal sheet 602. Continuous vapor barrier 618 has complimentary adhesive tabs 624 and 622 for joining together the vapor barriers 618 of adjacent panels 102, 104, 106, and 108.

Sheet metal screws 620 (two of four labeled) fasten corrugated metal sheet 602 to girt 502. Fiberglass batt insulation 626 is laid in between girts 502 and between purlins 502. In various embodiments, the position of L-shaped brackets 504 may be varied to adapt to thicker or thinner sheets of insulation 626, responsive to particular design requirements for each particular embodiment.

Cross brace tabs 610 (not visible in this view, as its interior surface is flush with the interior surface of the girt 503) extend from the web 302 of column 118 to fastenably receive cross brace 612 on the left and cross brace 616 on the right. The cross braces 612 and 616 extend diagonally across the interior of wall panel 106. Cross brace tab 610 is welded in place at the factory. A plurality of bolts 614 (one of six labeled; three visible in this view), preferably in a three-by-three array, fasten the cross brace 612 to cross brace tab 610. Preferably, two sets of cross braces 612 across 616 and 642 across 644 are used in each panel 102, 104, 106, and 108. The configuration of roof panels 102 and 104 is similar to wall panels 106 and 108. Interior corrugated metal sheet 604 is supported by girts 502 and is further supported by cross braces 612, 616. 642, and 644.

Figure 6C:
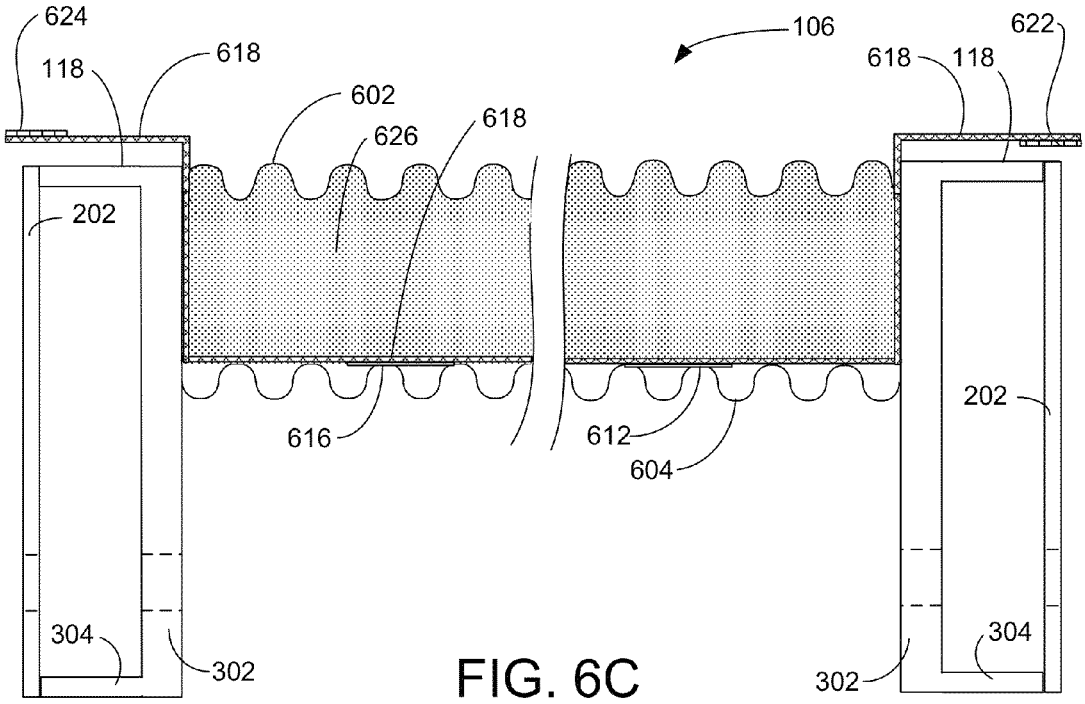
FIG. 6C is a top transverse cross-sectional view from cross-section CC of FIG. 6A illustrating an exemplary embodiment of a wall panel of the exemplary section of the exemplary improved folding building system of FIG. 1, according to a preferred embodiment of the present invention.

FIG. 6C is a top transverse cross-sectional view from cross-section CC of FIG. 6A illustrating an exemplary embodiment of a wall panel 106 of the exemplary section 100 of the exemplary improved folding building system of FIG. 1, according to a preferred embodiment of the present invention. FIG. 6C more clearly shows the insulation 626 abutting vapor barrier 618 which abuts cross braces 616 and 612 and interior corrugated metal sheet 604.

Figure 6D:
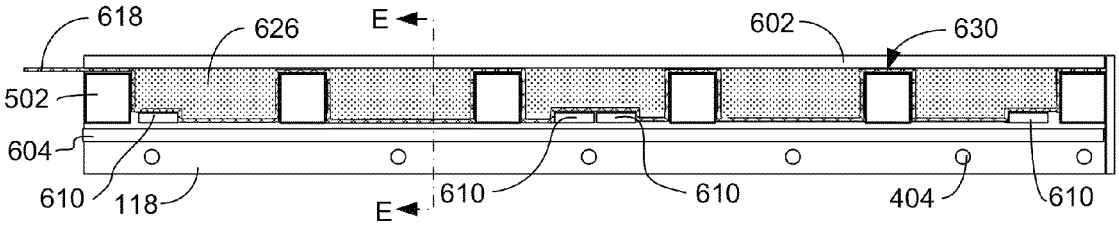
FIG. 6D is a vertical transverse cross-sectional view from cross-section DD of FIG. 6A illustrating an exemplary embodiment of a wall panel of the exemplary section of the exemplary improved folding building system of FIG. 1 and defining cross section EE, according to a preferred embodiment of the present invention.

FIG. 6D is a vertical transverse cross-sectional view from cross-section DD of FIG. 6A illustrating an exemplary embodiment of a wall panel 106 of the exemplary section 100 of the exemplary improved folding building system of FIG. 1 and defining cross section EE, according to a preferred embodiment of the present invention. Vapor barrier 618 can be seen to conformally wrap girts 502 (one of six labeled), although the tightness of the wrapping shown is exaggerated for simplicity of the drawing. Insulation 626 (one section of five labeled) can be seen to be supported on the vapor barrier 618 which, in turn, is supported on the cross braces 612 and 616, the girts 502, and the interior corrugated sheet metal 604. On the left of the drawing, the extension of vapor barrier 618 for coupling to a roof panel vapor barrier can be seen. The junctures 630 (one of six labeled) of the exterior corrugated metal sheet 602 with the vapor barrier 618 wrapped on girt 502 is shown. Fasteners 620 (exemplified as screws in the illustration) are used at junctures 630 to secure the exterior corrugated metal sheet 602 to the girts 502. The thermal break tape, applied to the girts 502 between the girts 502 and the vapor barrier 618, is too small to display in this view. Cross section EE will be taken without the insulation 626 to better show the vapor barrier 618.

Figure 6E:
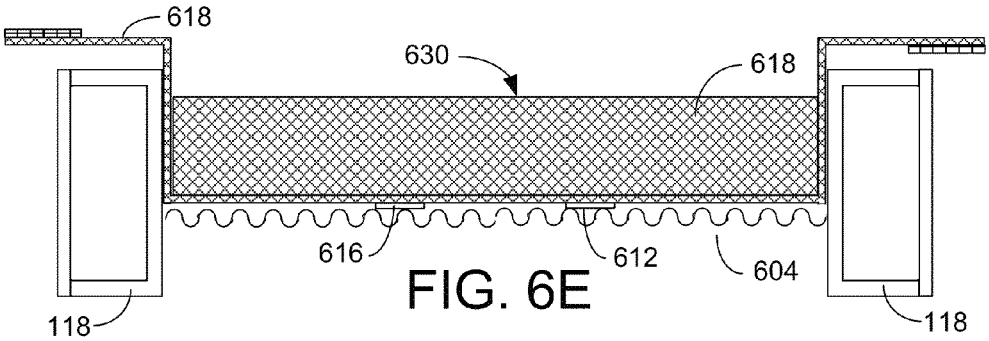
FIG. 6E is a horizontal transverse cross-sectional view from cross-section EE of FIG. 6D illustrating an exemplary embodiment of a wall panel of the exemplary section of the exemplary improved folding building system of FIG. 1, according to a preferred embodiment of the present invention.

FIG. 6E is a horizontal transverse cross-sectional view from cross-section EE of FIG. 6D illustrating an exemplary embodiment of a wall panel 106 of the exemplary section 100 of the exemplary improved folding building system of FIG. 1, according to a preferred embodiment of the present invention. The wrapping of vapor barrier 618 over a girt 502 is shown. Left and right side extensions of vapor barrier 618 couple to similar extensions on adjacent sections 100 when sections 100 are coupled together.

Figure 7:
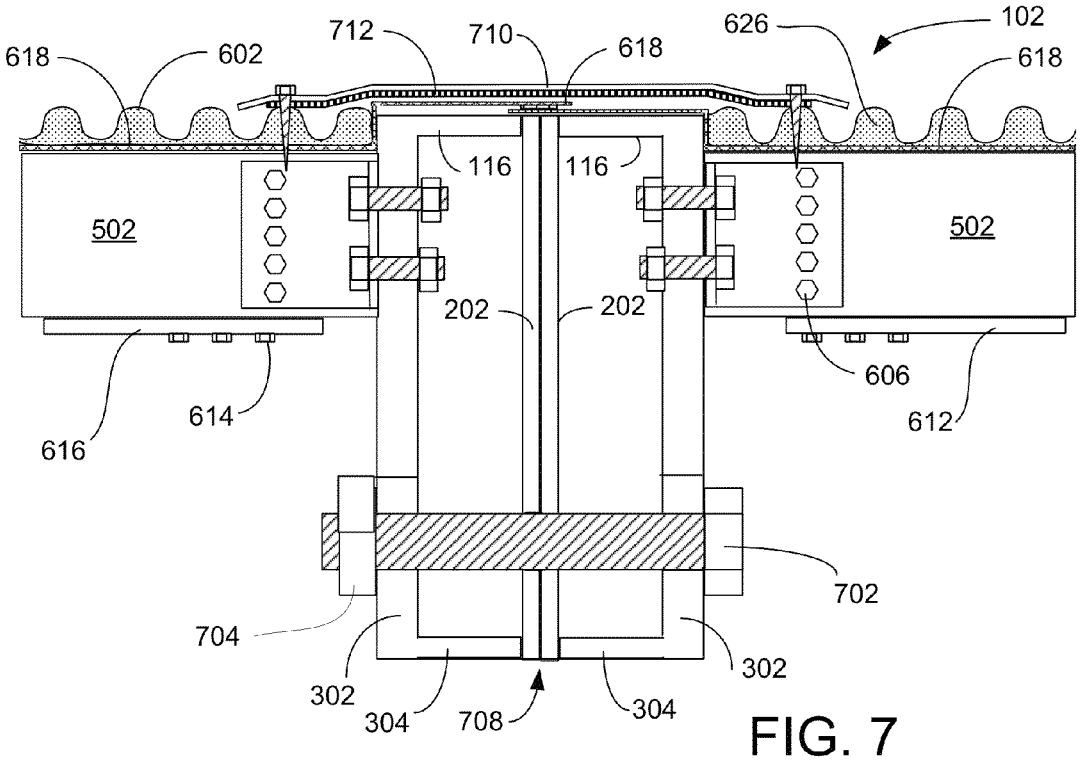
FIG. 7 is a top transverse cross-sectional view illustrating a joint between two exemplary sections of the exemplary improved folding building system of FIG. 1, according to a preferred embodiment of the present invention.

FIG. 7 is a top transverse cross-sectional view illustrating a joint 708 between two exemplary sections 100 of the exemplary improved folding building system of FIG. 1, according to a preferred embodiment of the present invention. The joint 708 between two rafters 116 shows two aligned bracket plates 202 abutting and receiving bolt 702 through holes 204 and 404 in bracket plates 202 and webs 302, respectively. Nut 704 receives and fastens bolt 702. Joint 708 is between two rafters 116 and is similar to joints between columns 118 when fastening sections 100 together. Note that, where bracket plates 202 are not present along the length of a rafter 116 or column 118, there will be a gap between flanges 304 equal to twice the thickness of a bracket plate 202. Precut gauge metal flashing 710 with pre-adhered closed cell foam rubber insulation 712 is used along the extent of the adjacent rafters 116 or columns 118 to close that gap. The flashing 710 acts as a weather seal, thermal break, and joint seal. While shown separated for simplicity of illustration, flashing 710 with pre-adhered closed cell foam rubber insulation 712 and vapor barrier 618 are preferably installed tightly on rafters 116. Insulation 626 is preferably batt insulation 626 with a vapor barrier 618 and is sufficiently supported on purlins 502 and cross braces 616 and 612 such that interior corrugated metal sheet 604 is not required on roof panels 102, thereby saving weight on the roof. In particular embodiments, interior corrugated metal sheet 604 may be omitted from wall panels 106 and 108.

Figure 8:
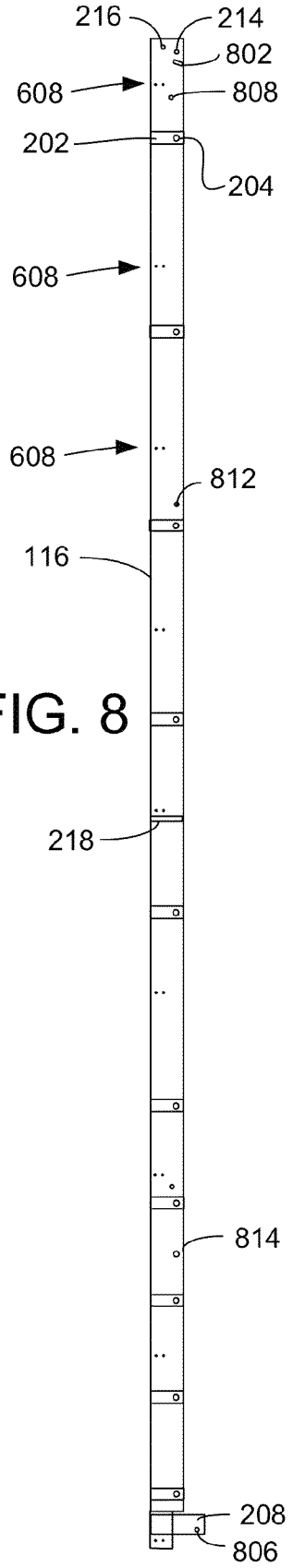
FIG. 8 is an outside side elevation view illustrating an exemplary embodiment of a rafter of the section of the exemplary improved folding building system of FIG. 1, according to a preferred embodiment of the present invention.

FIG. 8 is an outside side elevation view illustrating an exemplary embodiment of a rafter 116 of the section 100 of the exemplary improved folding building system of FIG. 1, according to a preferred embodiment of the present invention. The illustrated rafter 116 has nine pairs of bolt holes 608 (three of nine pairs labeled) for L-shaped brackets 504 and ten bracket plates 202. Rafter plate stop 802 defines a limit for the roof angle during erection. Rafter plate stop 802 is an improvement in that it allows construction crews to easily set the correct roof angle. Pivot hole 806 receives bolt 206 which allows column 118 to pivot at the edge of the roof when bolt 206 is loosened. Electrical holes 808 (one of two labeled) allow for routing of electrical cabling between rafters after building installation. In addition, a lifting sleeve 218 is fixed between and opening through the flanges 304 of the rafter 116 that allows use of a long-shank hoist ring. The lifting sleeve 218 is an improvement that enables removal of the lifting hardware by a worker on aerial equipment (such as a man hoist) without accessing the roof. Bolt holes 812 and 814 are for attaching ridge braces 112 and corner braces 114, respectively.

Figure 9:
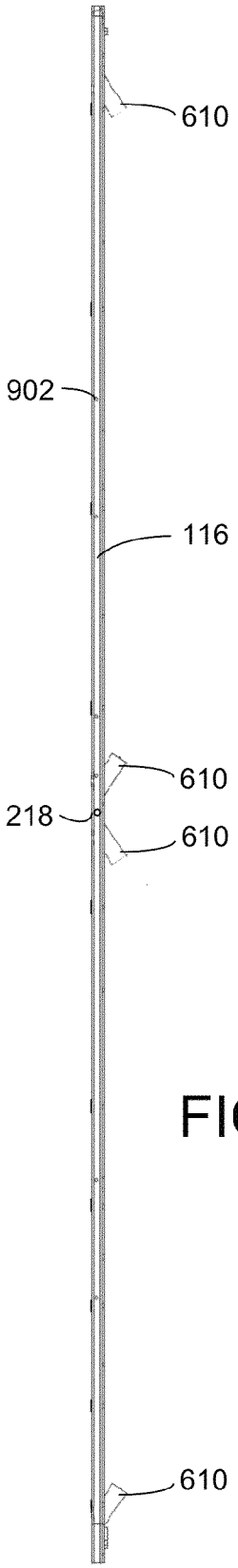
FIG. 9 is a front elevation view illustrating an exemplary embodiment of a rafter of the section of the exemplary improved folding building system of FIG. 1, according to a preferred embodiment of the present invention.

FIG. 9 is a front elevation view illustrating an exemplary embodiment of a rafter 116 of the section 100 of the exemplary improved folding building system of FIG. 1, according to a preferred embodiment of the present invention. Openings 902 (one of seven labeled) through the flange 304 provide attachment points to assist in securing the rafter 116 to other rafters 116 and columns 118 during transport, handling and erection. Openings 902 also provide attachment points for lifting hardware during handling and erection.

Figure 10:
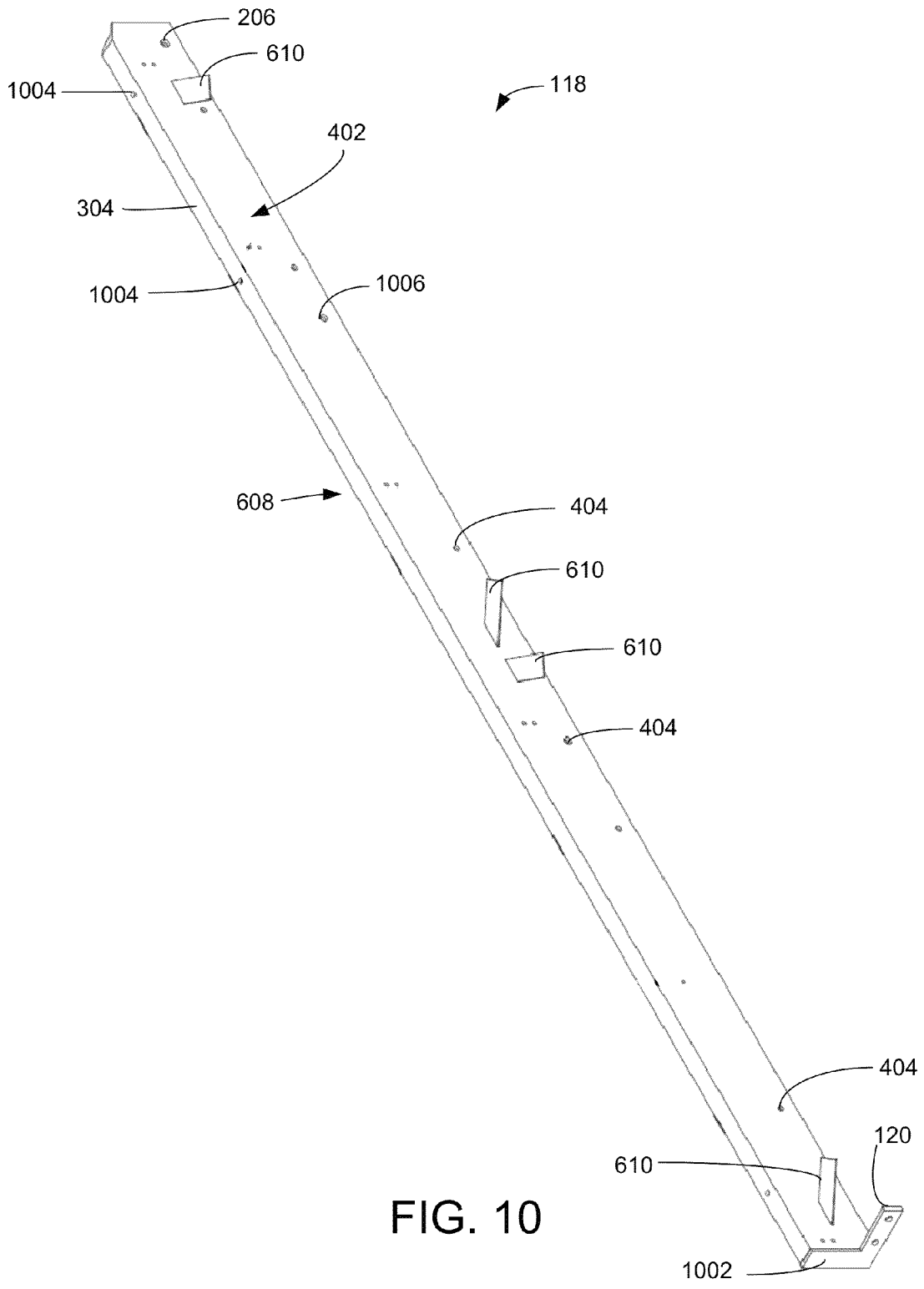
FIG. 10 is a perspective view illustrating an exemplary embodiment of a column of the section of the exemplary improved folding building system of FIG. 1, according to a preferred embodiment of the present invention.

FIG. 10 is a perspective view illustrating an exemplary embodiment of a column 118 of the section 100 of the exemplary improved folding building system of FIG. 1, according to a preferred embodiment of the present invention. Column 118 has five pairs of bolt holes 608 (one of five pairs labeled) for L-shaped brackets 504. Cross-brace tabs 610 can best be seen in this view. Holes 1004 through the flange 304 (two of three labeled) assist in hoisting and securing the column 118. Base plate 1002 is fixed to the bottom of column 118 and has an extension 120 with two, and optionally more, bolt holes. The extension supports a caster 1802 (see FIG. 18) during hoisting and is used to bolt 1704 (see FIG. 17) the column 118 to the concrete, wood, or similarly functional pad 2050 (see FIG. 20I) during operation.

Figure 11:
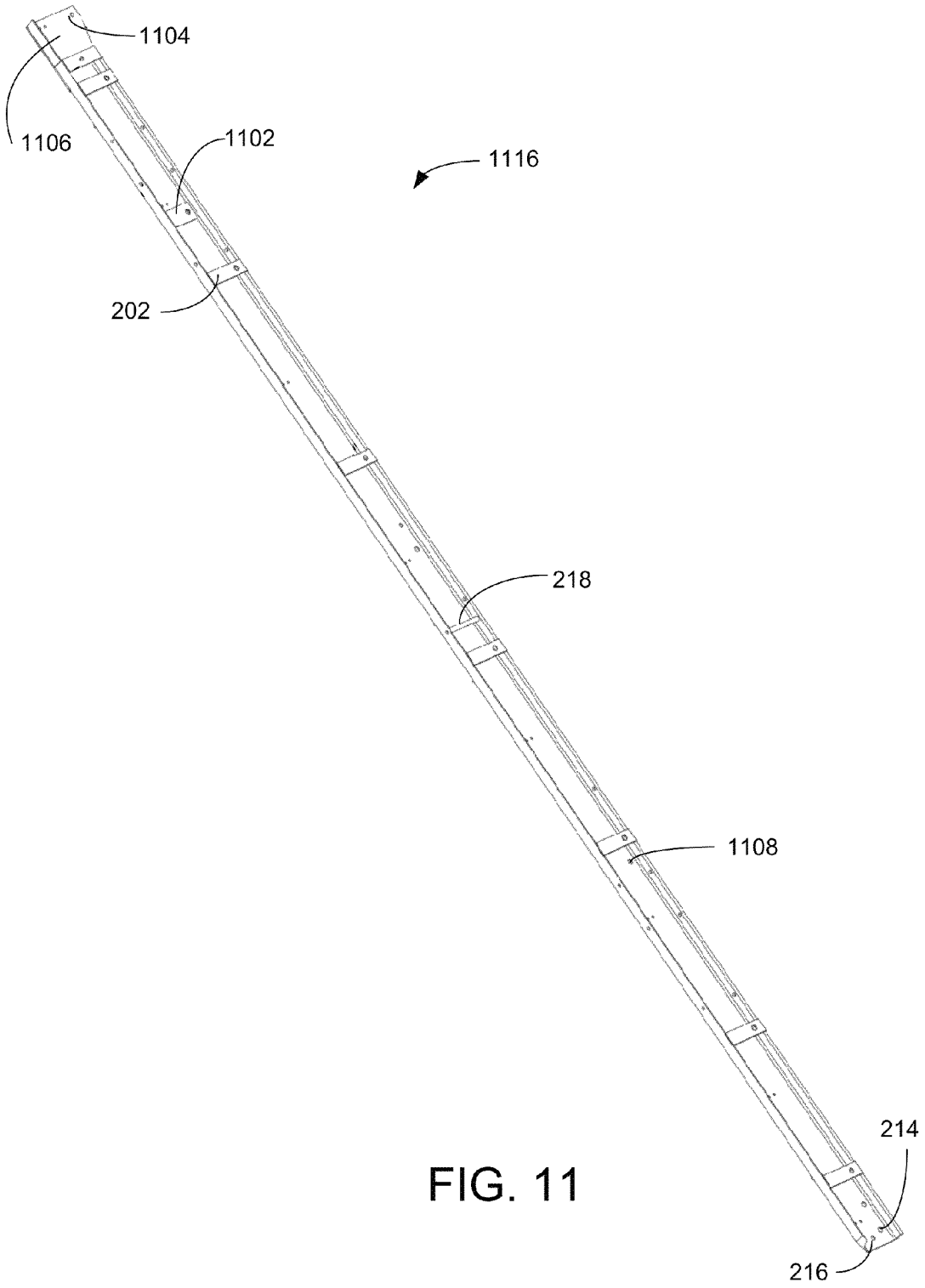
FIG. 11 is a perspective view illustrating a second exemplary embodiment of a rafter of the section of the exemplary improved folding building system of FIG. 1, according to a preferred embodiment of the present invention.

FIG. 11 is a perspective view illustrating a second exemplary embodiment of a rafter 1116 of the section 100 of the exemplary improved folding building system of FIG. 1, according to a preferred embodiment of the present invention. This embodiment has seven bracket plates 202 (one of seven labeled) and a lifting sleeve 218. Reinforcement plate 1102 is welded to the web 302 and is an exemplary embodiment of a corner brace 114 attachment point. Wall pivot hole 1104 in flange 1106 provides a pivotable connection to the wall panel 106 or 108 during erection. Bolt hole 1108 is an exemplary ridge brace 112 attachment point.

Figure 12:
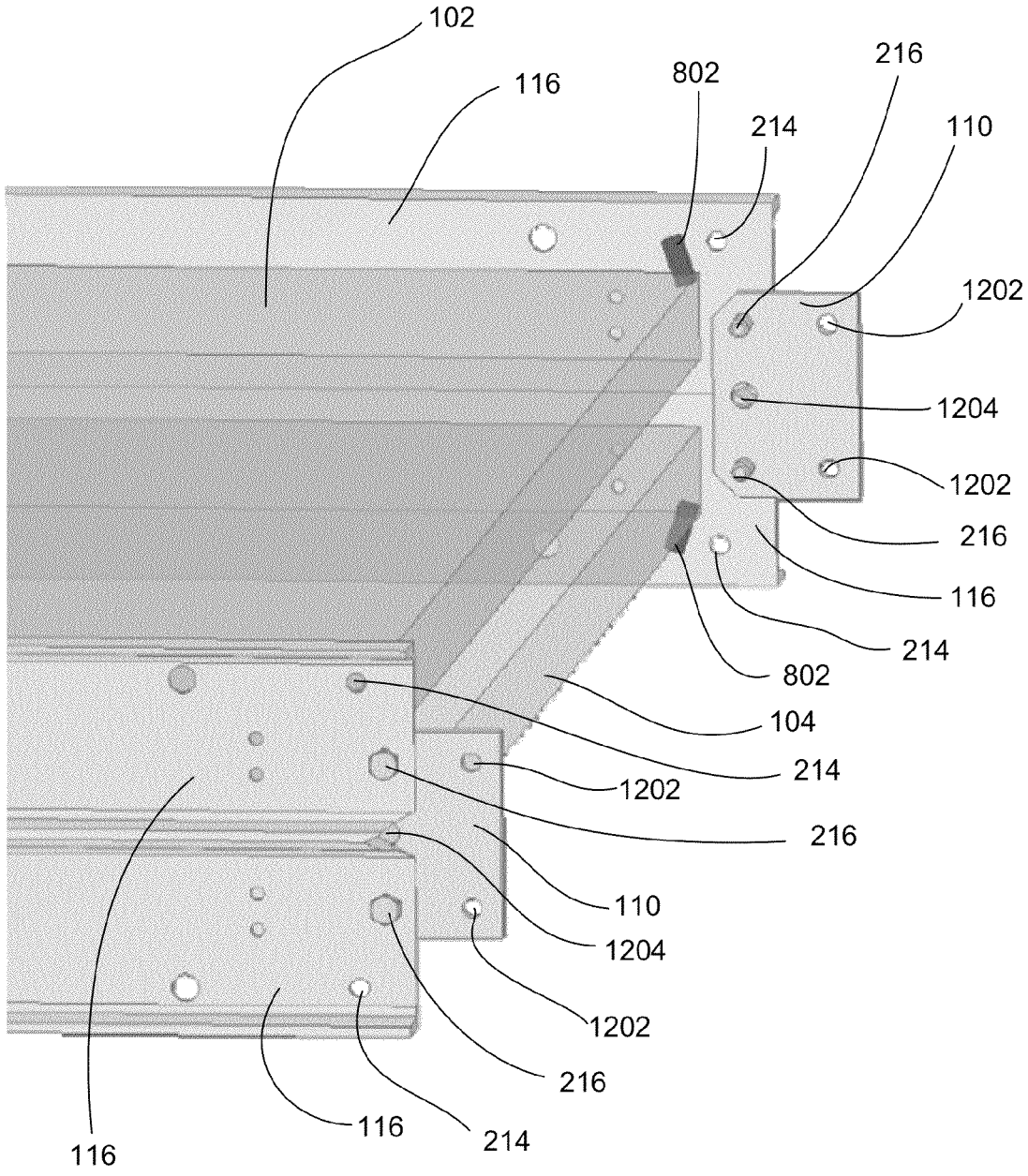
FIG. 12 is a perspective view illustrating an exemplary embodiment of a detail of the section of the exemplary improved folding building system of FIG. 1 in a folded configuration, according to a preferred embodiment of the present invention.

FIG. 12 is a perspective view illustrating an exemplary embodiment of a detail of the section 100 of the exemplary improved folding building system of FIG. 1 in a folded configuration, according to a preferred embodiment of the present invention. In folded configuration, rafters 116 of roof panel 102 lie on top of rafters 116 of roof panel 104, as shown, and the first and second rafters 116 of roof panel 102 are pivotably coupled to first and second rafters 116 of roof panel 104 by first and second rafter plates 110, respectively, by bolts 216. Lower rafter plate bolt holes 1202 will ultimately be rotated to align with respective rafter bolt holes 214 to receive bolts 1514 (see FIG. 15). Rafter plate stops 802 are fixed to the web 302 of rafters 116 and engage the sides (top and bottom, in this view) of rafter plate 110 when the roof panels 102 and 104 are arranged in the desired angular relationship. Hoisting hole 1204 in rafter plate 110 is for hoisting during erection and as a fall arrest anchor during work on the roof to install flashing (see FIG. 23) and the like.

Figure 13:
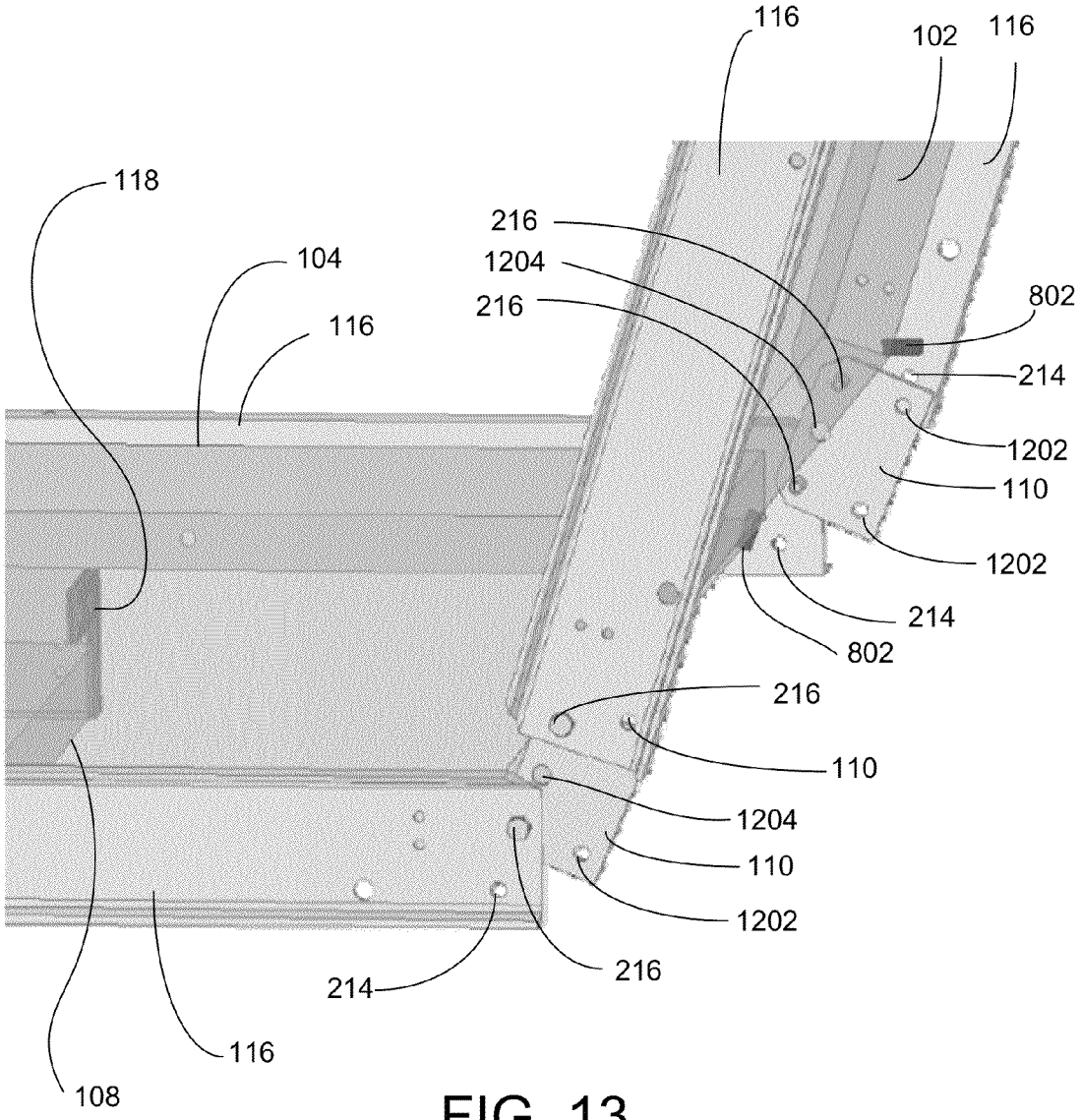
FIG. 13 is a perspective view illustrating an exemplary embodiment of a detail of the section of the exemplary improved folding building system of FIG. 1 in a partially unfolded configuration, according to a preferred embodiment of the present invention.

FIG. 13 is a perspective view illustrating an exemplary embodiment of a detail of the section 110 of the exemplary improved folding building system of FIG. 1 in a partially unfolded configuration, according to a preferred embodiment of the present invention. Columns 118 of wall panels 108 (shown) and 106 (not visible in this view) are still attached to rafters 116 of roof panels 104 and 102 during the initial unfolding from the folded state shown in FIG. 2. Pivoting in the unfolding configuration is about loosened bolts 216. Thus, there are two pivot points on each side of the roof panels 102 and 104 of the section 100.

Figure 14:
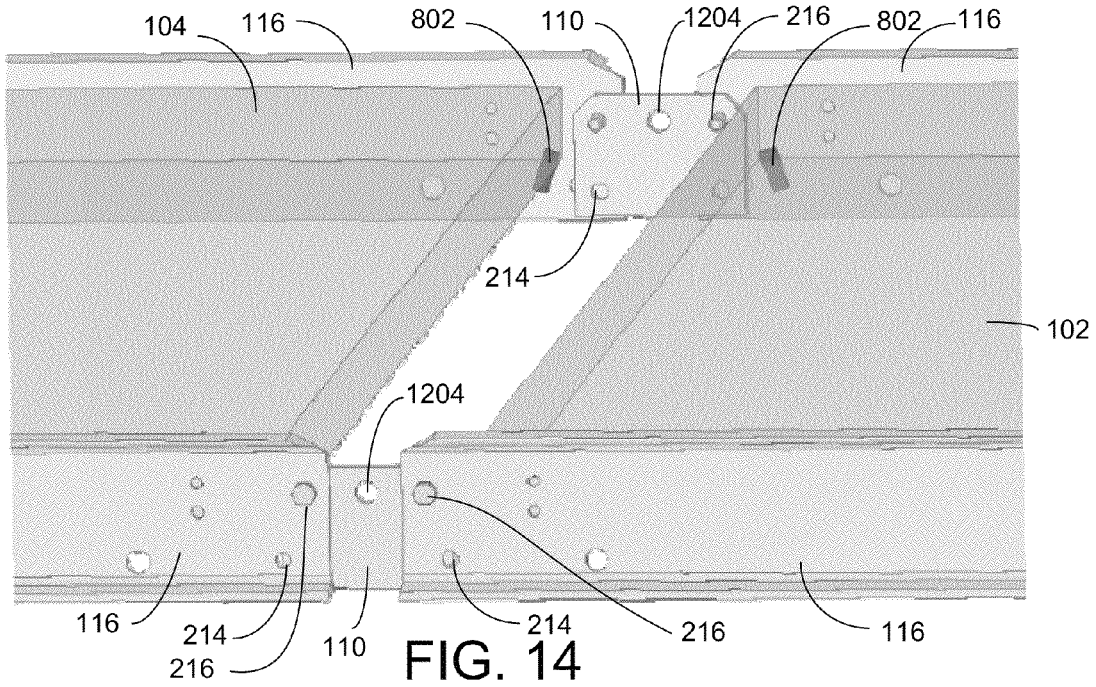
FIG. 14 is a perspective view illustrating an exemplary embodiment of a detail of the section of the exemplary improved folding building system of FIG. 1 in a fully unfolded configuration, according to a preferred embodiment of the present invention.

FIG. 14 is a perspective view illustrating an exemplary embodiment of a detail of the section 100 of the exemplary improved folding building system of FIG. 1 in a fully unfolded configuration, according to a preferred embodiment of the present invention. In this state, the wall panels 108 and 106 are on the ground beneath the roof panels 104 and 102, respectively, and the hoisting holes 1204 in the rafter plates 110 are accessible.

Figure 15:
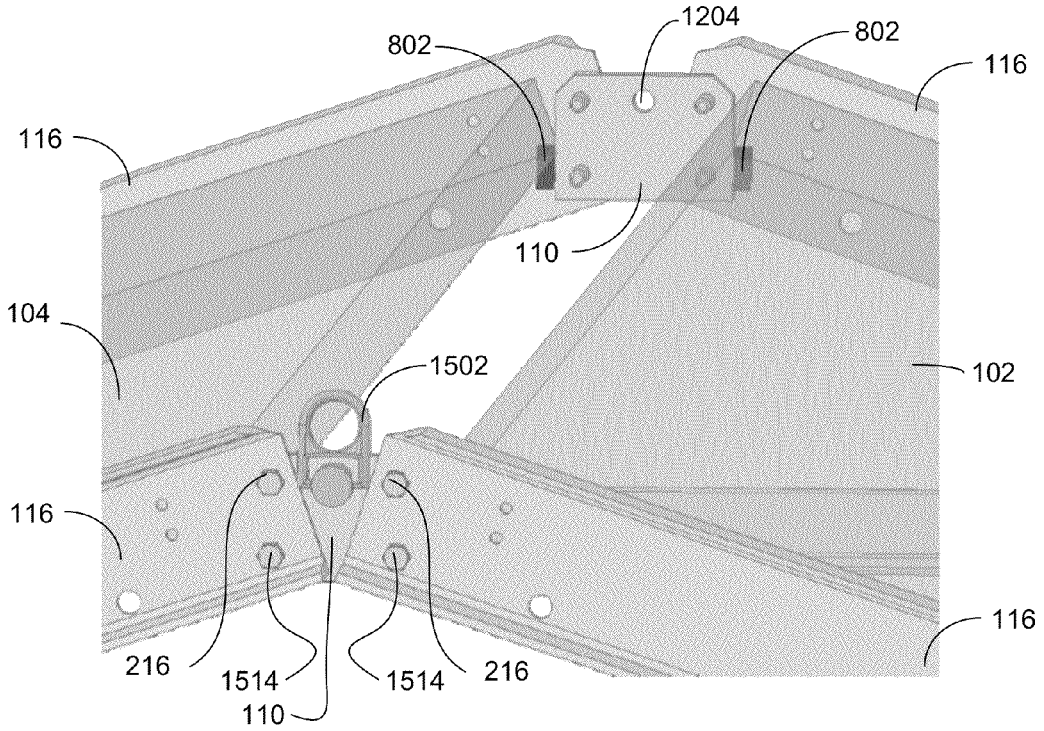
FIG. 15 is a perspective view illustrating an exemplary embodiment of a detail of the section of the exemplary improved folding building system of FIG. 1 in a erected configuration, according to a preferred embodiment of the present invention.

FIG. 15 is a perspective view illustrating an exemplary embodiment of a detail of the section 100 of the exemplary improved folding building system of FIG. 1 in an erected configuration, according to a preferred embodiment of the present invention. By hoisting at the hoisting holes 1204 of the rafter plate 110 using a crane and a spreader bar, the angle of the roof is set as the sides of rafter plates abut rafter plate stops 802, as shown. Bolts 1514 (two of four labeled) are installed and tightened, bolts 1216 (two of four labeled) are tightened, and ridge braces 112 are installed. A fall arrest harness line anchor 1502 may be installed in hoisting hole 1204 for the safety of workers on the roof when hoisting operations are complete.

Figure 16:
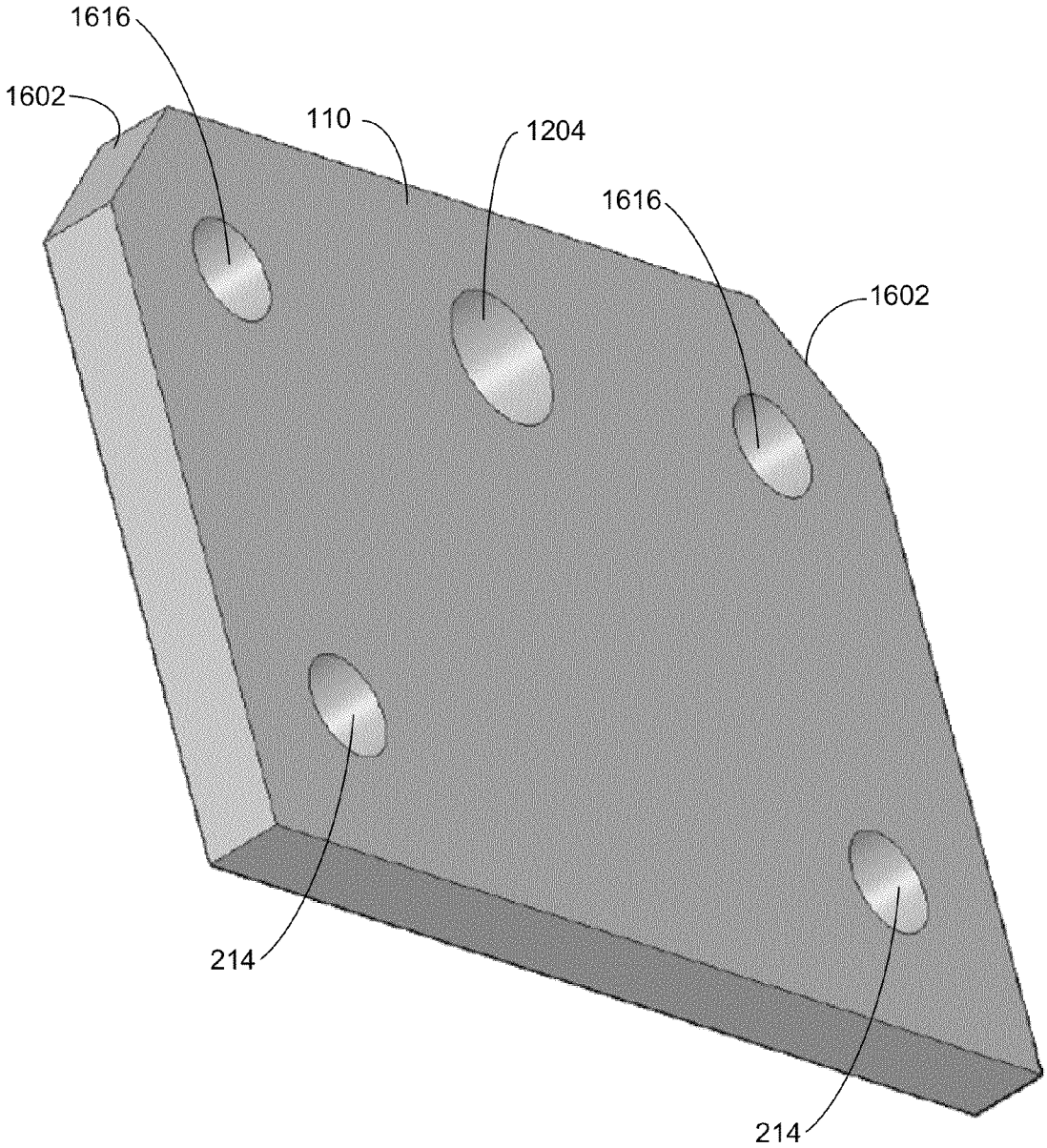
FIG. 16 is a perspective view illustrating an exemplary embodiment of the rafter plate of the section of the exemplary improved folding building system of FIG. 1, according to a preferred embodiment of the present invention.

FIG. 16 is a perspective view illustrating an exemplary embodiment of the rafter plate 110 of the section 100 of the exemplary improved folding building system of FIG. 1, according to a preferred embodiment of the present invention. The thickness and size of rafter plate 110 is adapted to the size and design of the particular folding building. Rafter plate 110 is made of a strong rigid material, preferably of steel. The spacing between bolt holes 214 and bolt holes 1616 is determined by the size of the rafter channels 116 and the angle between the roof panels 102 and 104. The advantage of this novel improved rafter plate 110 is that one rafter plate 110 can serve as a double pivot, which eases unfolding; an angle gauge, in conjunction with the rafter plate stops 802; a spacer between roof panels 102 and 104; a lift point for raising the roof; a fall arrest harness anchor; and a fastening plate between roof panels 102 and 104.

Figure 17:
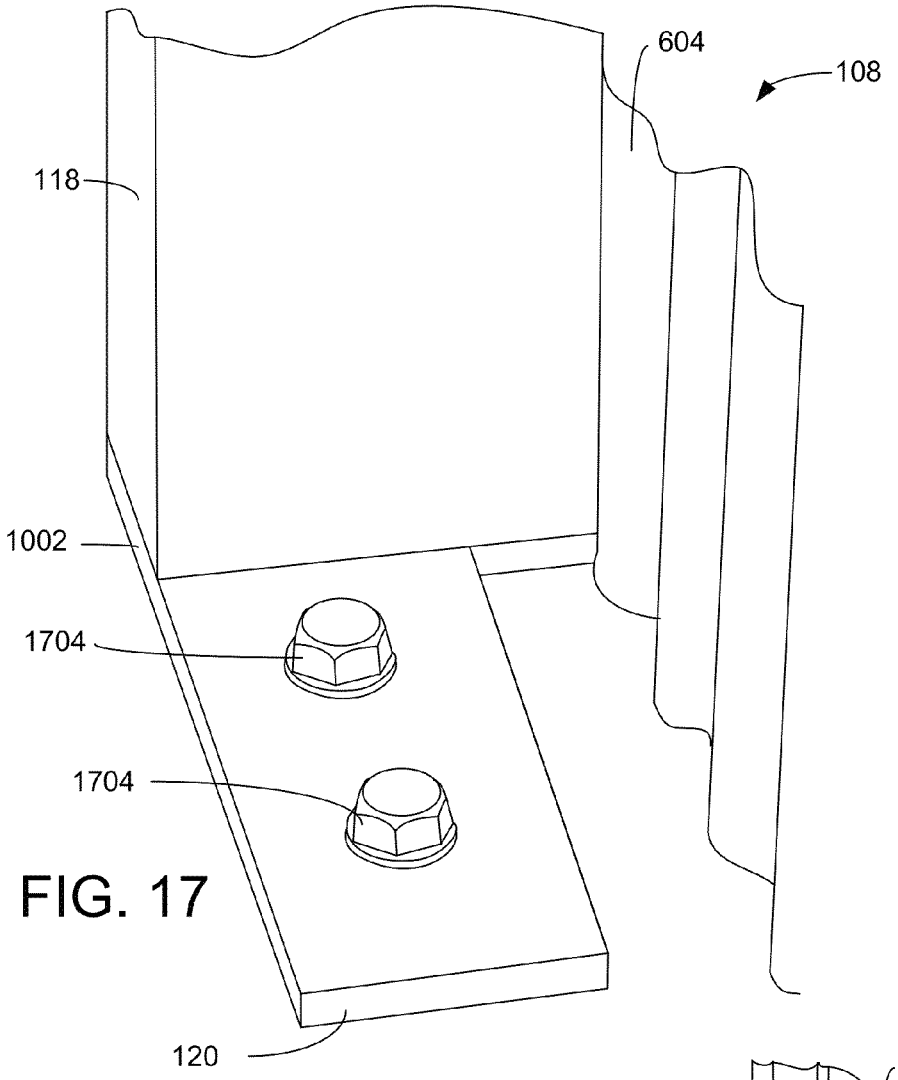
FIG. 17 is a perspective view illustrating an exemplary detail of an exemplary base plate of the section of the exemplary improved folding building system of FIG. 1, according to a preferred embodiment of the present invention.

FIG. 17 is a perspective view illustrating an exemplary detail of an exemplary base plate 1002 of the section 100 of the exemplary improved folding building system of FIG. 1, according to a preferred embodiment of the present invention. A base plate 1002 is welded to the bottom of each column 118 of wall panel 108 (and 106) along the ends of the flanges 304 and end of the web 302, as shown. Base plate 1002 has a flange, or extension, 120 that extends toward the opposed column 118 of that wall panel 108 (or 106) and has at least two bolt holes (not visible) for releasably receiving anchors 1704 for fastening the column 118 to a concrete, wood, or similarly suitable pad 2050 (see FIG. 20I) on which the wall panel 108 or 106 rests. The design of the improved base plate 1002 has the advantage of not increasing the thickness of the wall panel 108 and so can be welded on at the factory, rather than in the field. Prior to bolting to the concrete, wood, or similarly functional pad 2050 (see FIG. 20I), the bolt holes of extension 120 receive caster bolts 1808 (see FIG. 18) for releasably fastening casters 1802 to the bottom of each column 118.

Figure 18:
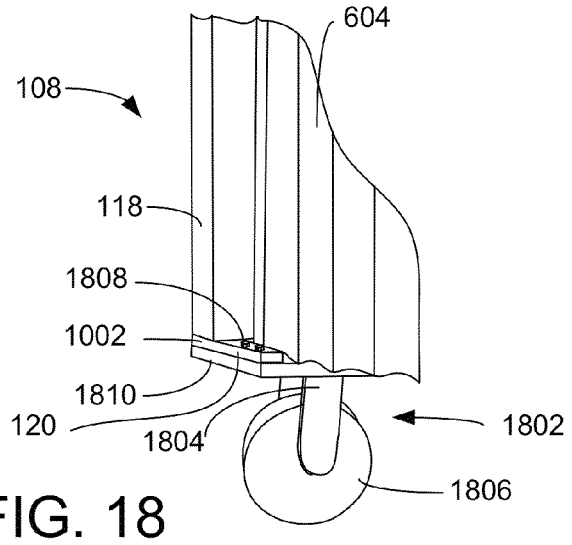
FIG. 18 is a perspective view illustrating an exemplary detail of an exemplary caster of the section of the exemplary improved folding building system of FIG. 1, according to a preferred embodiment of the present invention.

FIG. 18 is a perspective view illustrating an exemplary detail of an exemplary caster 1802 of the section 100 of the exemplary improved folding building system of FIG. 1, according to a preferred embodiment of the present invention. Caster 1802 includes attachment plate 1810, axle support arms 1804, and caster wheel 1806. Axle support arms 1804 are preferably rigidly coupled to attachment plate 1810. Bolts 1808 releasably fasten attachment plate 1810 to extension 120 of base plate 1002. During erection, after the ridge braces 112 are installed, the lifting of the roof by crane causes the bottom edges of wall panels 106 and 108 to slide along the pad 2050 (see FIG. 20I) as they swing into position like pendulums. The casters 1802 are an improvement that ease the motion of the wall panels 106 and 108 into position and reduce damage to the bottom of the wall panel and to the pad 2050 (see FIG. 20I). Once wall panels 106 and 108 are in vertical position, the corner braces 114 are installed, and the entire section 100 is lifted to remove the casters 1802.

Figure 19:
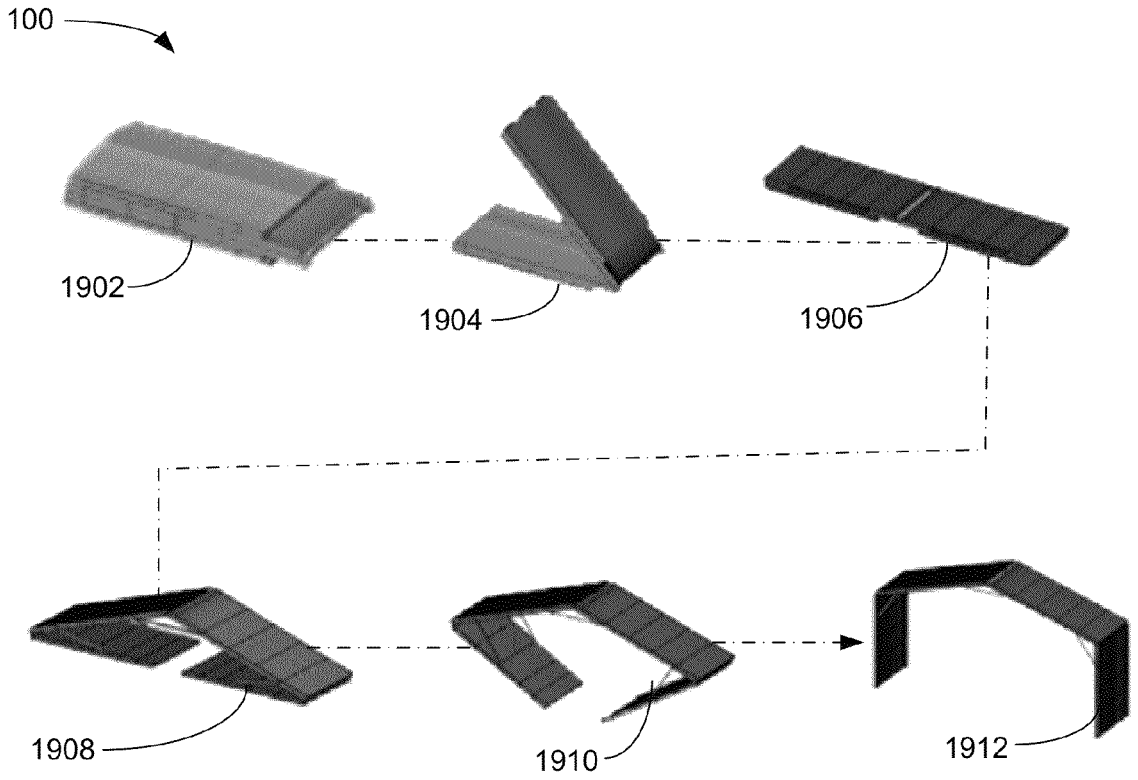
FIG. 19 is a perspective view illustrating an exemplary erection sequence of the section of the exemplary improved folding building system of FIG. 1, according to a preferred embodiment of the present invention.

FIG. 19 is a perspective view illustrating an exemplary erection sequence of the section 100 of the exemplary improved folding building system of FIG. 1, according to a preferred embodiment of the present invention. The folded section 100 is placed with the rafter plates 110 over the centerline of the concrete pad 2050 (see FIG. 20I) in step 1902. Placement 1902 is by four-point lift using a spreader bar and a crane. By a crane lift from opposed points near the joint between the top wall panel 106 and the connected roof panel 102, the folded section 100 is unfolded in step 1904, as detailed in FIG. 13. Step 1904 uses holes 204 in brackets 202 on opposite sides of the wall panel 108 to accommodate swivel hoist rings for the lift. The unfolding of section 100 is completed in step 1906, as detailed in FIG. 14. In step 1908, for buildings forty feet wide and smaller, the section 100 is lifted by rafter plates 110 via lifting hardware in hoisting holes 1204 using a crane. For buildings with walls longer than roof panels, see FIGS. 20A-20I. The ridge braces 112 and then casters 1802 are installed in this step 1908. In step 1910, for buildings forty feet wide and smaller, the section 100 is lifted by rafter plates 110 via lifting hardware in hoisting holes 1204 using a crane. For buildings more than forty feet wide, the section 100 is lifted via lifting hardware in lifting sleeves 218 using a crane. The casters 1802 (not visible in this view) allow the wall panels 106 and 108 to roll into vertical position. In step 1912, corner braces 114 are installed and the entire structure is lifted off the ground to allow for the casters 1802 to be removed. The section is then lowered to the ground, squared carefully on the concrete pad 2050 (see FIG. 20I), and anchored 1704 to the pad 2050 (see FIG. 20I). Another section 100 is then erected in the same way and fastened to the adjacent section 100 using bolts 702, as detailed in FIG. 7.

When the desired number of sections 100 have been erected and fastened together, end panel sections 2202, 2204, 2206, 2302, and 2306 (see FIGS. 22-23) are installed to close off each end of the improved foldable building 2100. End panel sections 2202, 2204, 2206, 2302, and 2306 (see FIGS. 22-23) may have openings framed by columns and girts for receiving pre-framed bolt-in doors 2304 and windows. Roof panels 102 and 104 may have openings for skylights and the like. Wall panels 106 and 108 may have openings for windows and doors in various embodiments. This approach has the advantage of reducing door and window installation time in the field. Doors may include, for non-limiting examples, personnel access doors 2304 (see FIG. 23), overhead roll-up doors, and sliding doors.

Figure 20A:
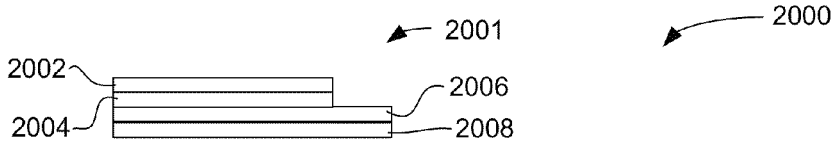
FIG. 20A is a diagrammatic view illustrating a second exemplary section of a second exemplary improved folding building in an exemplary first step of construction, according to a preferred embodiment of the present invention.

FIG. 20A is a diagrammatic view illustrating a second exemplary section 2000 of a second exemplary improved folding building in an exemplary first step 2001 of construction, according to a preferred embodiment of the present invention. The second exemplary section 2000 has wall panels 2006 and 2008 that are longer than roof panels 2002 and 2004. The panels 2002, 2004, 2006, and 2008 are fastened together with shipping fasteners, but are not pivotably coupled as in sections 100. In step 2001, the stack of panels 2002, 2004, 2006, and 2008 is delivered to the construction site and the panels are unfastened each from the other.

Figure 20B:
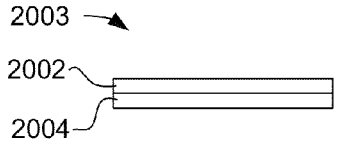
FIG. 20B is a diagrammatic view illustrating a second exemplary section of a second exemplary improved folding building in an exemplary second step of construction, according to a preferred embodiment of the present invention.

FIG. 20B is a diagrammatic view illustrating a second exemplary section 2000 of a second exemplary improved folding building in an exemplary second step 2003 of construction, according to a preferred embodiment of the present invention. In step 2003, roof panels 2002 and 2004 are removed from the stack and placed on the pad 2050 (see FIG. 20I).

Figure 20C:
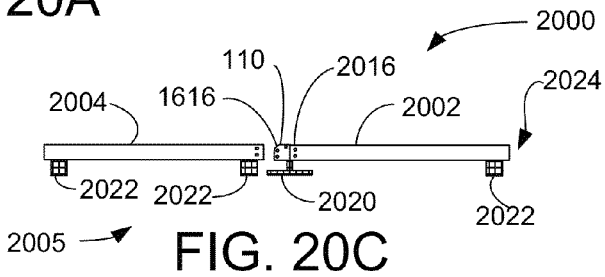
FIG. 20C is a diagrammatic view illustrating a second exemplary section of a second exemplary improved folding building in an exemplary third step of construction, according to a preferred embodiment of the present invention.

FIG. 20C is a diagrammatic view illustrating a second exemplary section 2000 of a second exemplary improved folding building in an exemplary third step 2005 of construction, according to a preferred embodiment of the present invention. In step 2005, roof panel 2002 is supported by dunnage 2022 and by erection aid 2020, as shown; rafter plates 110 are pivotably coupled via one fastener 2016 (similar to fasteners 216 of FIG. 12) in each rafter plate 110 and rafter 116 of roof panel 2002. Roof panel 2004 is removed from the stack and supported on dunnage 2022; roof panel 2004 is aligned to roof panel 2002. Rafter plate 110 has holes 1616 (one on each side) for pivotably receiving bolts 2016.

Figure 20D:
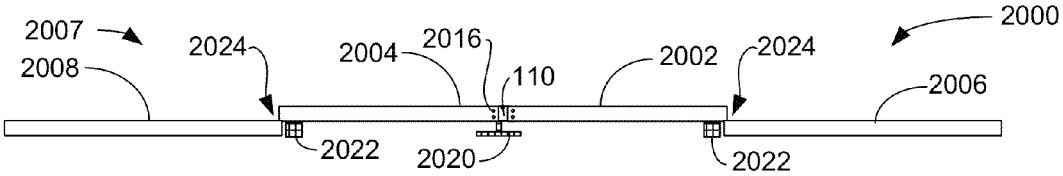
FIG. 20D is a diagrammatic view illustrating a second exemplary section of a second exemplary improved folding building in an exemplary fourth step of construction, according to a preferred embodiment of the present invention.

FIG. 20D is a diagrammatic view illustrating a second exemplary section 2000 of a second exemplary improved folding building in an exemplary fourth step 2007 of construction, according to a preferred embodiment of the present invention. In step 2007, wall panel 2008 is aligned to roof panel 2004 and positioned to pivotably couple joint 2024. Left roof-wall joint 2024 is pivotably coupled with one bolt, or similar fastener, on each side of panels 2004 and 2008. Right roof-wall joint 2024 is coupled by one bolt on each side of the roof panels 2002 and 2006. Roof panel 2004 is pivotably coupled to roof panel 2002 via bolt 2016 through hole 1616. Casters 1802 (not shown in this view, but see FIG. 18) are releasably attached to the base plates 1002 of wall panels 2006 and 2008.

Figure 20E:
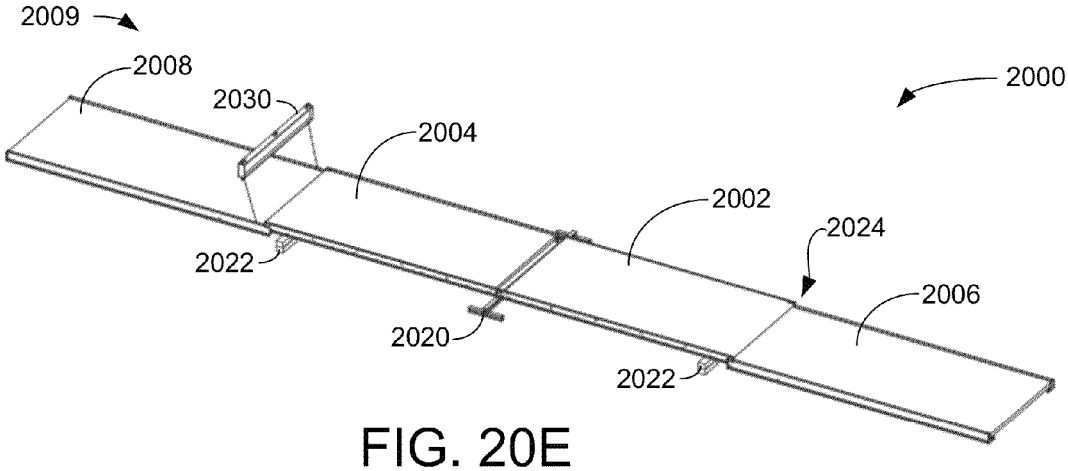
FIG. 20E is a perspective view illustrating a second exemplary section of a second exemplary improved folding building in an exemplary fifth step of construction, according to a preferred embodiment of the present invention.

FIG. 20E is a perspective view illustrating a second exemplary section 2000 of a second exemplary improved folding building in an exemplary fifth step 2009 of construction, according to a preferred embodiment of the present invention. In step 2009, a hoisting bar 2030 is releasably attached to wall panel 2008 using swivel hoist rings installed on each side in the first hole 204 from the top of the wall panel 2008 in each column 118. Casters 1802 are installed to the base of wall panels 2006 and 2008.

Figure 20F:
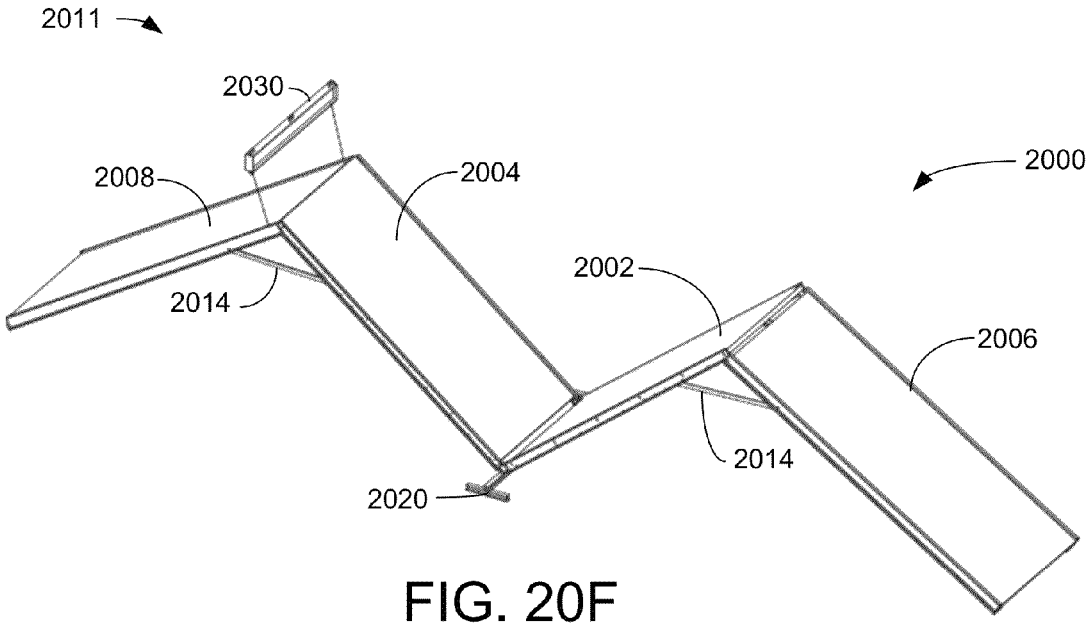
FIG. 20F is a perspective view illustrating a second exemplary section of a second exemplary improved folding building in an exemplary sixth step of construction, according to a preferred embodiment of the present invention.

FIG. 20F is a perspective view illustrating a second exemplary section 2000 of a second exemplary improved folding building in an exemplary sixth step 2011 of construction, according to a preferred embodiment of the present invention. In step 2011, each wall panel 2008 and 2006 is hoisted, in turn, until the desired angles between wall panels 2008 and 2006 and roof panels 2004 and 2002, respectively, are attained and corner braces 2014 (similar to 114, but sized for the illustrated embodiment) can be attached and secured on both sides of section 2000.

Figure 20G:
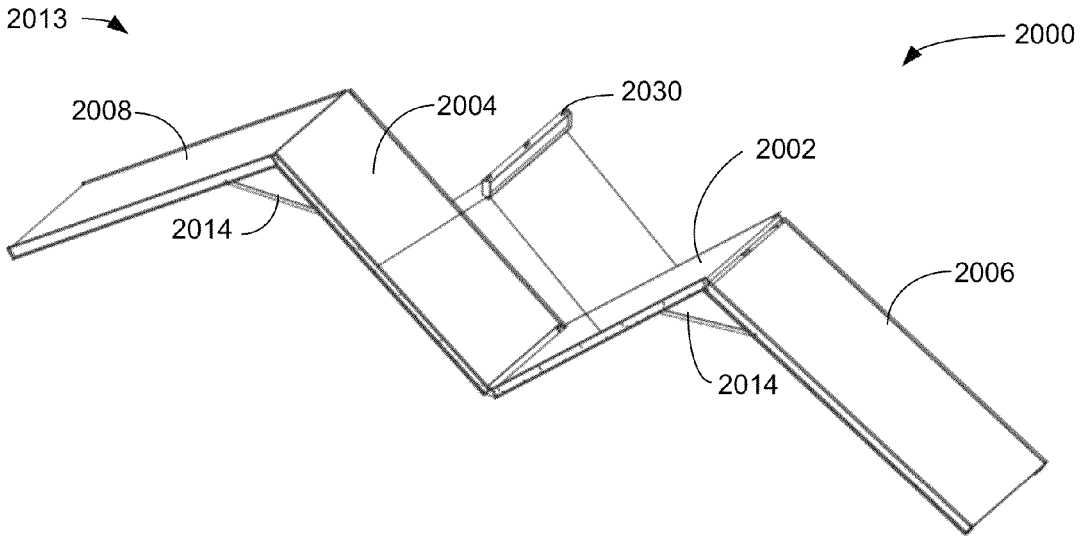
FIG. 20G is a perspective view illustrating a second exemplary section of a second exemplary improved folding building in an exemplary seventh step of construction, according to a preferred embodiment of the present invention.

FIG. 20G is a perspective view illustrating a second exemplary section 2000 of a second exemplary improved folding building in an exemplary seventh 2013 step of construction, according to a preferred embodiment of the present invention. In step 2013, hoisting bar 2030 is coupled via cables to long shank hoist rings installed in both lifting sleeves 218 on each of roof panels 2002 and 2004.

Figure 20H:
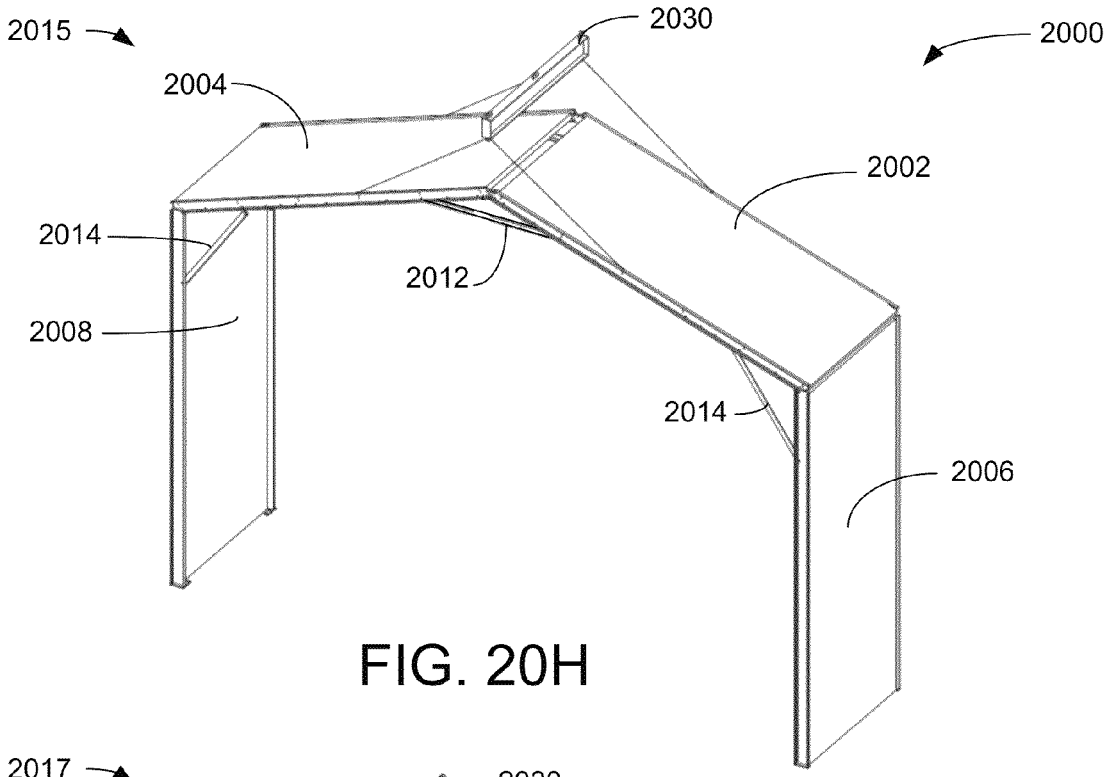
FIG. 20H is a perspective view illustrating a second exemplary section of a second exemplary improved folding building in an exemplary eighth step of construction, according to a preferred embodiment of the present invention.

FIG. 20H is a perspective view illustrating a second exemplary section 2000 of a second exemplary improved folding building in an exemplary eighth step 2015 of construction, according to a preferred embodiment of the present invention. In step 2015, hoisting bar 2030 is lifted by crane to bring the roof panels 2002 and 2004 into the desired angular relationship, and ridge braces 2012 (similar to ridge braces 112, but sized for the illustrated embodiment) are attached and secured, as shown, on both sides of section 2000.

Figure 20I:
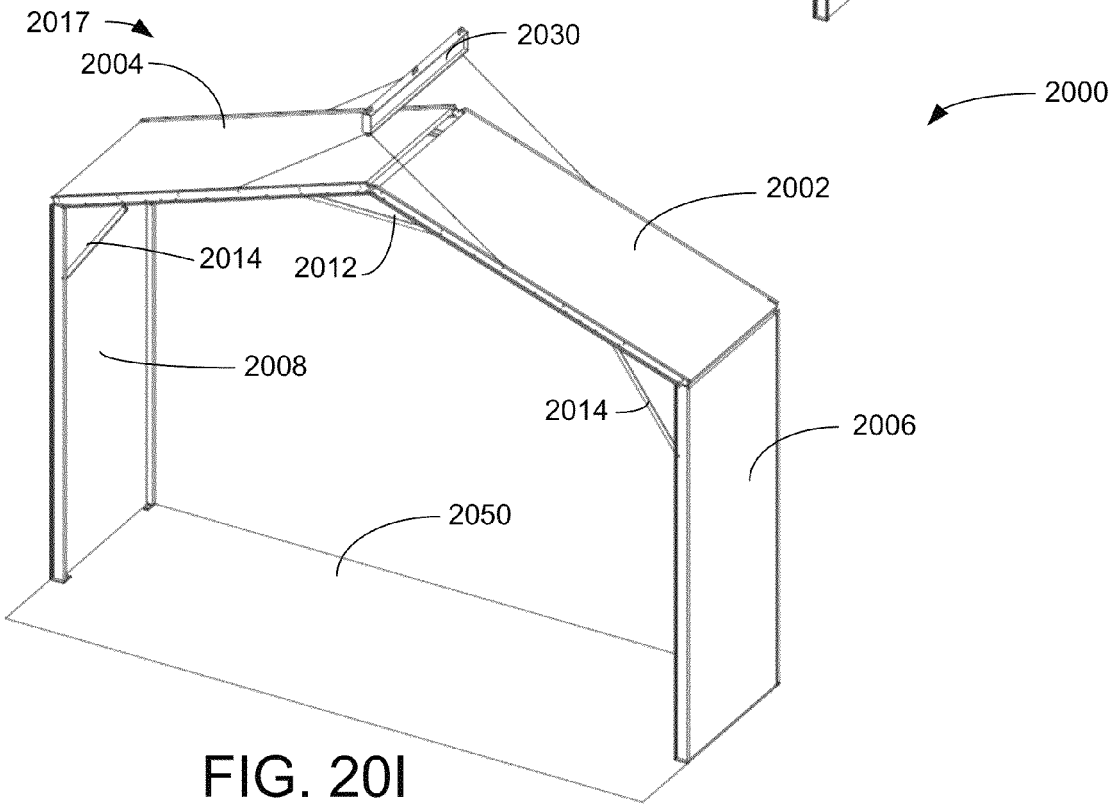
FIG. 20I is a perspective view illustrating a second exemplary section of a second exemplary improved folding building in an exemplary fourth step of construction, according to a preferred embodiment of the present invention.

FIG. 20I is a perspective view illustrating a second exemplary section 2000 of a second exemplary improved folding building in an exemplary ninth step 2017 of construction, according to a preferred embodiment of the present invention. In step 2017, the casters 1802 are removed and assembled section 2000 is oriented on pad 2050 (see FIG. 20I) 2050 and secured to the pad 2050 (see FIG. 20I). Pad 2050 may be a concrete slab or other foundation that can receive and hold an anchor, such as a compacted level surface.

Figure 21:
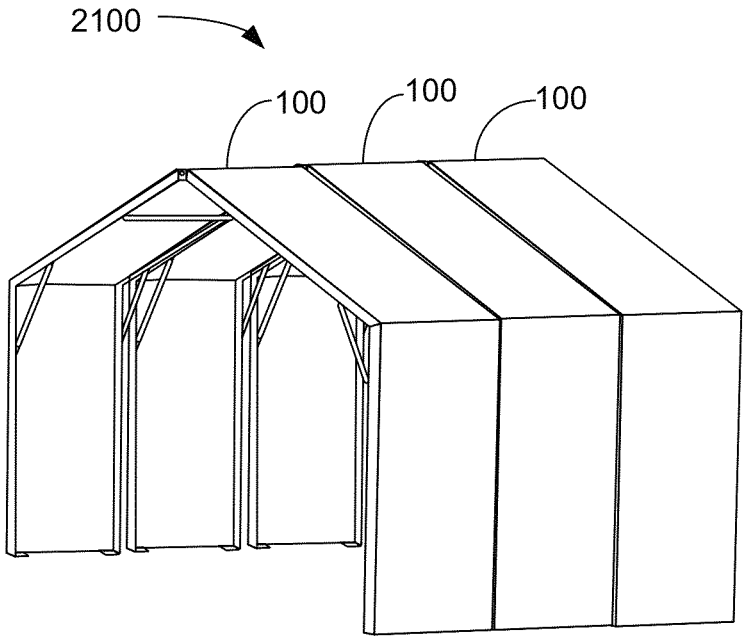
FIG. 21 is a perspective view of illustrating an exemplary three-section foldable building in the process of being constructed, according to a preferred embodiment of the present invention.

FIG. 21 is a perspective view of illustrating an exemplary three-section 100 improved foldable building 2100 in the process of being constructed, according to a preferred embodiment of the present invention. Three sections 100 have been aligned, fastened together, and fastened to a pad 2050 (see FIG. 20I) to form the walls and roof of an improved foldable building 2100. Any number of sections 100 can be fastened together to form an improved foldable building 2100 of any desired size.

Figure 22:
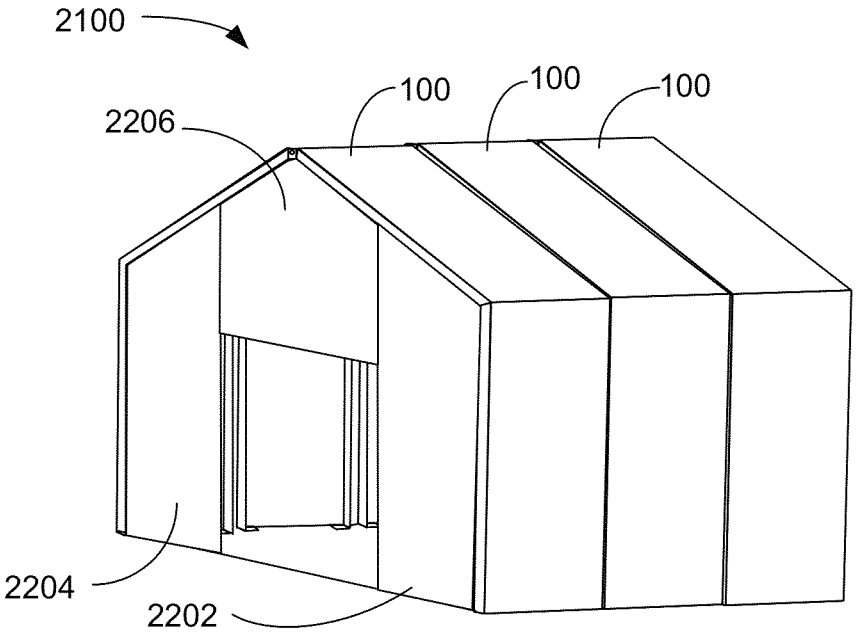
FIG. 22 is a perspective view of illustrating the exemplary three-section foldable building of FIG. 21 further in the process of being constructed, according to a preferred embodiment of the present invention.

FIG. 22 is a perspective view of illustrating the exemplary three-section 100 improved foldable building of FIG. 21 further in the process of being constructed, according to a preferred embodiment of the present invention. The assembled and fastened together sections 100 form a shell 2100. End panels 2202, 2204, and 2206 have been installed to begin closing off the end of the shell 2100. End panel 2202 bolts onto rafters 116, to the pad 2050 (see FIG. 20I) and to the column 118 of the end section 100. End panels 2202, 2204, and 2206 use the same channel columns 118 and steel stud girts 502 as wall panels 106 and 108. Those of skill in the art, enlightened by the present disclosure, will appreciate the variety of patterns of end panels and combinations of end panels that can be used to close off the ends of the improved foldable building 2100.

Figure 23:
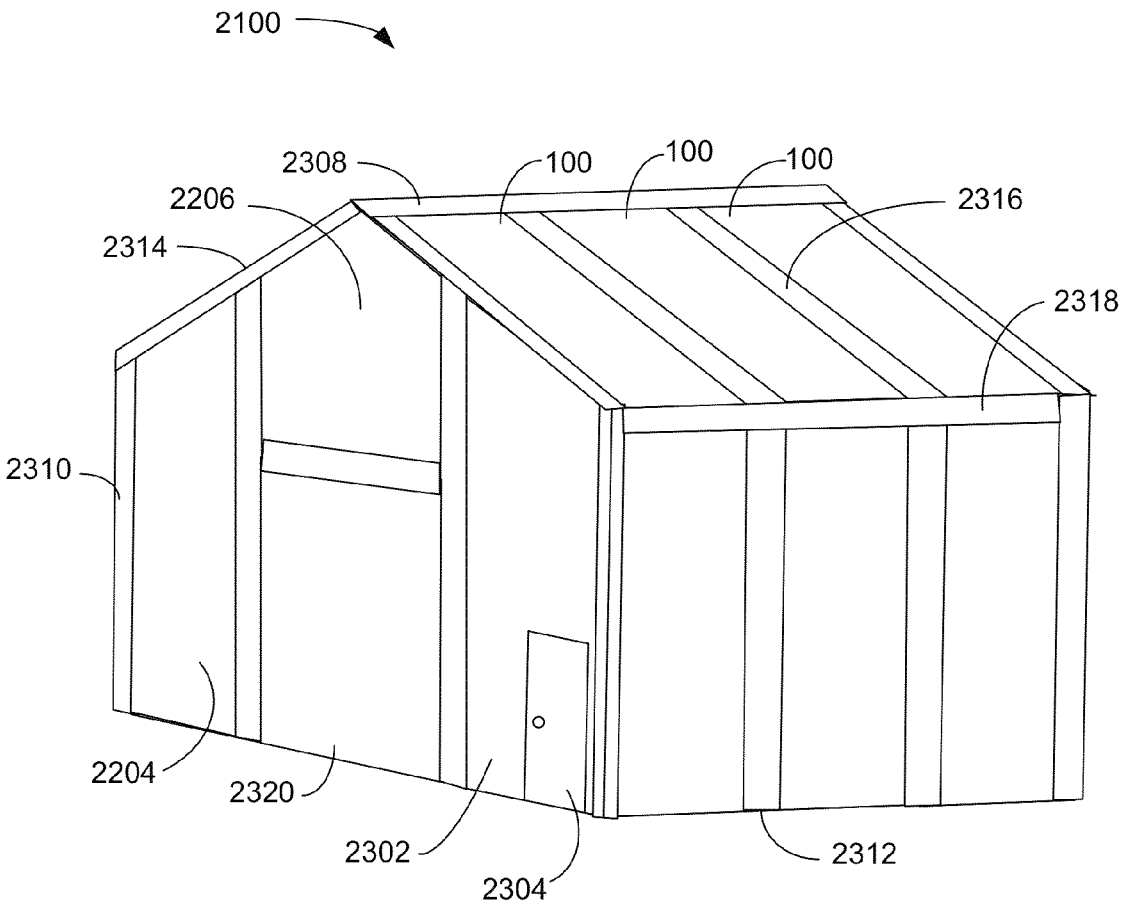
FIG. 23 is a perspective view of illustrating the exemplary three-section foldable building of FIG. 21 fully constructed, according to a preferred embodiment of the present invention.

FIG. 23 is a perspective view of illustrating the exemplary three-section 100 improved foldable building 2100 of FIG. 21 fully constructed, according to a preferred embodiment of the present invention. Second end panel 2302 has a pre-framed bolt-in door 2304 that bolts to columns 118 and girts 502 within second end panel 2302. Second end panel 2302 also bolts to rafter 116, to the pad 2050 (see FIG. 20I), to the outer column 118 of the adjacent wall panel 106, to the adjacent column of middle panel 2206. Third end panel 2206 also bolts to rafter 116, and to the outer column 118 of the adjacent end panels 2204 and 2302. Roll-down door 2320 completes the enclosure.

Ridge flashing 2308 has a solid outer shell and an adhered closed-cell foam inner lining to provide conformal fit and thermal and sound insulation. Ridge flashing 2308 overlaps roof lap flashing 2316 (one of two visible labeled) and gable flashing 2314 (one of three visible labeled). Eave flashing 2318 overlaps wall flashing 2312 (one of four visible labeled). Eave flashing 2318 extends from under the roof lap flashing 2316. Ridge flashing 2308, roof lap flashing 2316, eave flashing 2318, and corner flashing 2314 is supplied in pre-cut pieces ten feet in length, or in custom lengths, as required for a particular embodiment, to allow for safe handling. The closed-cell foam rubber backing 712 provides a weather sealing thermal break, and a seal for building joints. Hems are notched or opened for ease of installation, and rubber 712 is held back to allow tight and continuous joint details, particularly end joint details, with little or no field cutting required.

Figure 24:
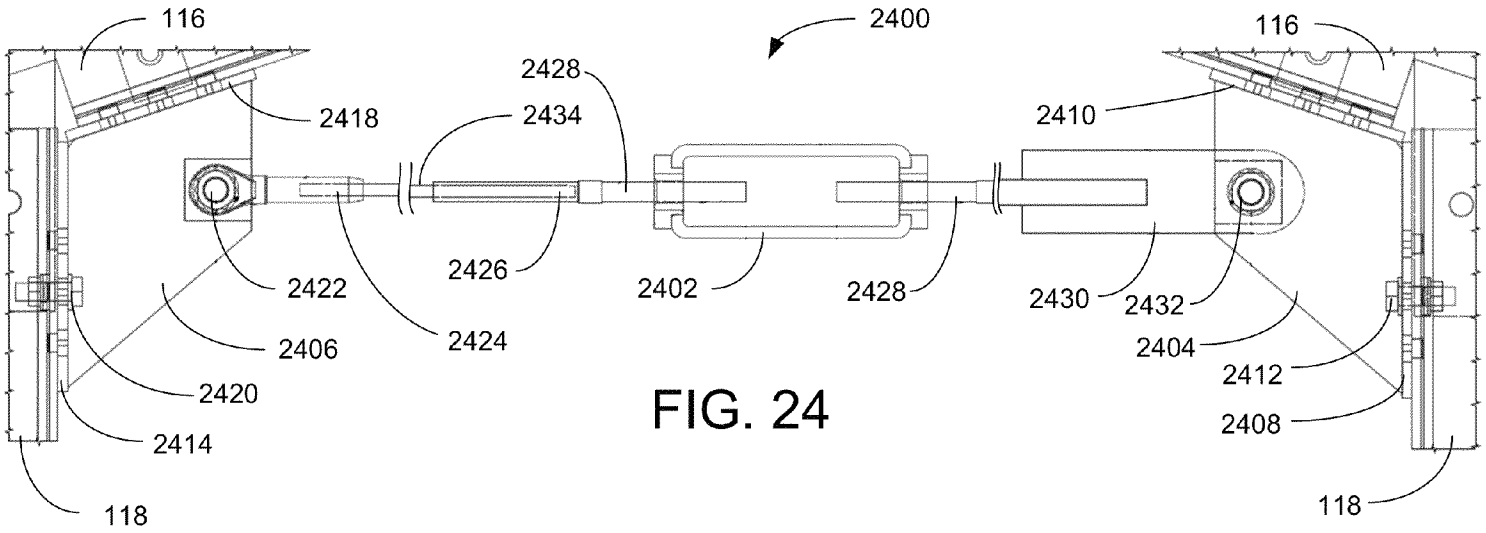
FIG. 24 is a front elevation view illustrating an exemplary tension cable and turnbuckle, according to a preferred embodiment of the present invention.

FIG. 24 is a front elevation view illustrating an exemplary embodiment 2400 of a tension cable 2434 and turnbuckle 2402, according to a preferred embodiment of the present invention. Tension cable 2434 is fastened between opposing column 118/rafter 116 corners of sections adjacent side door openings for additional support. A right side attachment plate 2404 has a column flange 2408 that is fastened by fastener 2412 to column 118 and a rafter flange 2410 that is fastened to rafter 116. A plate 2430 is fastened 2432 to right side attachment plate 2404 and to short rod 2428 which, in turn, is threadingly coupled to turnbuckle 2402. Turnbuckle 2402 is also threadingly coupled to cable coupling 2426 which, in turn, is attached to long cable 2434. Long cable 2434 is attached to second cable coupling 2424 which, in turn, is fastened by fastener 2422 to left side attachment plate 2406. Left side attachment plate 2406 has a column flange 2414 that is fastened by fastener 2420 to column 118 and a rafter flange 2418 that is fastened to rafter 116. In operation, turning the turnbuckle 2402 in a first rotational direction increases tension in the rods 2428 and cable 2434 and rotation in the opposite direction lessens tension in rods 2428 and cable 2434.

Figure 25:
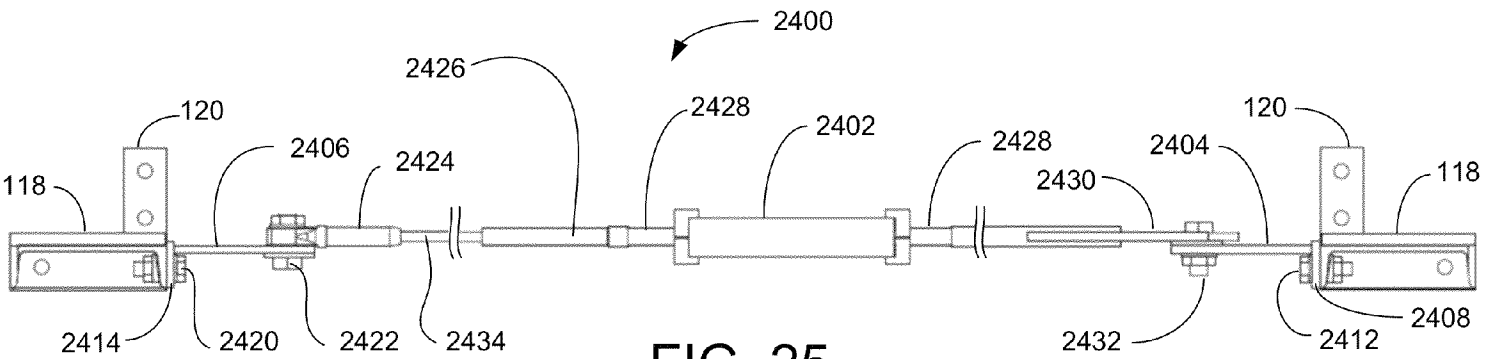
FIG. 25 is a top plan view illustrating the exemplary tension cable and turnbuckle of FIG. 24, according to a preferred embodiment of the present invention.

FIG. 25 is a top plan view illustrating the exemplary embodiment 2400 of the exemplary tension cable 2434 and turnbuckle 2402 of FIG. 24, according to a preferred embodiment of the present invention. The fasteners 2412, 2432, 2422, and 2420, illustrated here as bolts, can be more clearly seen in this view.

Figure 26:
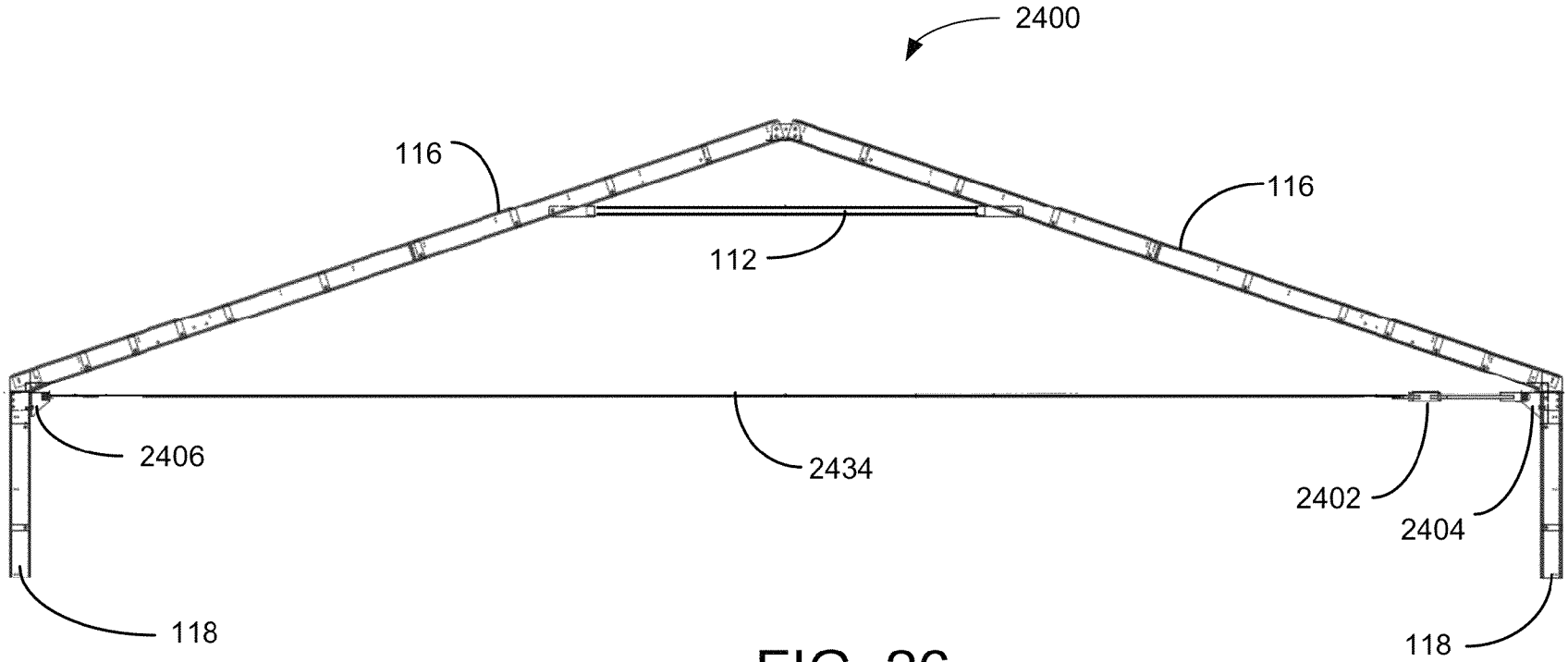
FIG. 26 is a front elevation view illustrating the exemplary tension cable and turnbuckle of FIG. 24 installed in an exemplary section of an improved folding building system, according to a preferred embodiment of the present invention.

FIG. 26 is a front elevation view illustrating the exemplary embodiment 2400 of the exemplary tension cable 2434 and turnbuckle 2404 of FIG. 24 installed in an exemplary section 100 of an improved folding building system, according to a preferred embodiment of the present invention. Turnbuckle 2402 is located near one column 118, rather than being centered. Two tension cables 2434 are installed with each section. The tension cable provides a low cost solution to increase building span and load carrying capabilities. The tension cable 2434 can be used with or without corner braces 114. The other primary use of the tension cable 2434 system is to take the place of corner braces 114 when their removal is required for clearance, such as in the case of a side wall truck door. Their use is not limited by size of building.

Figure 27:
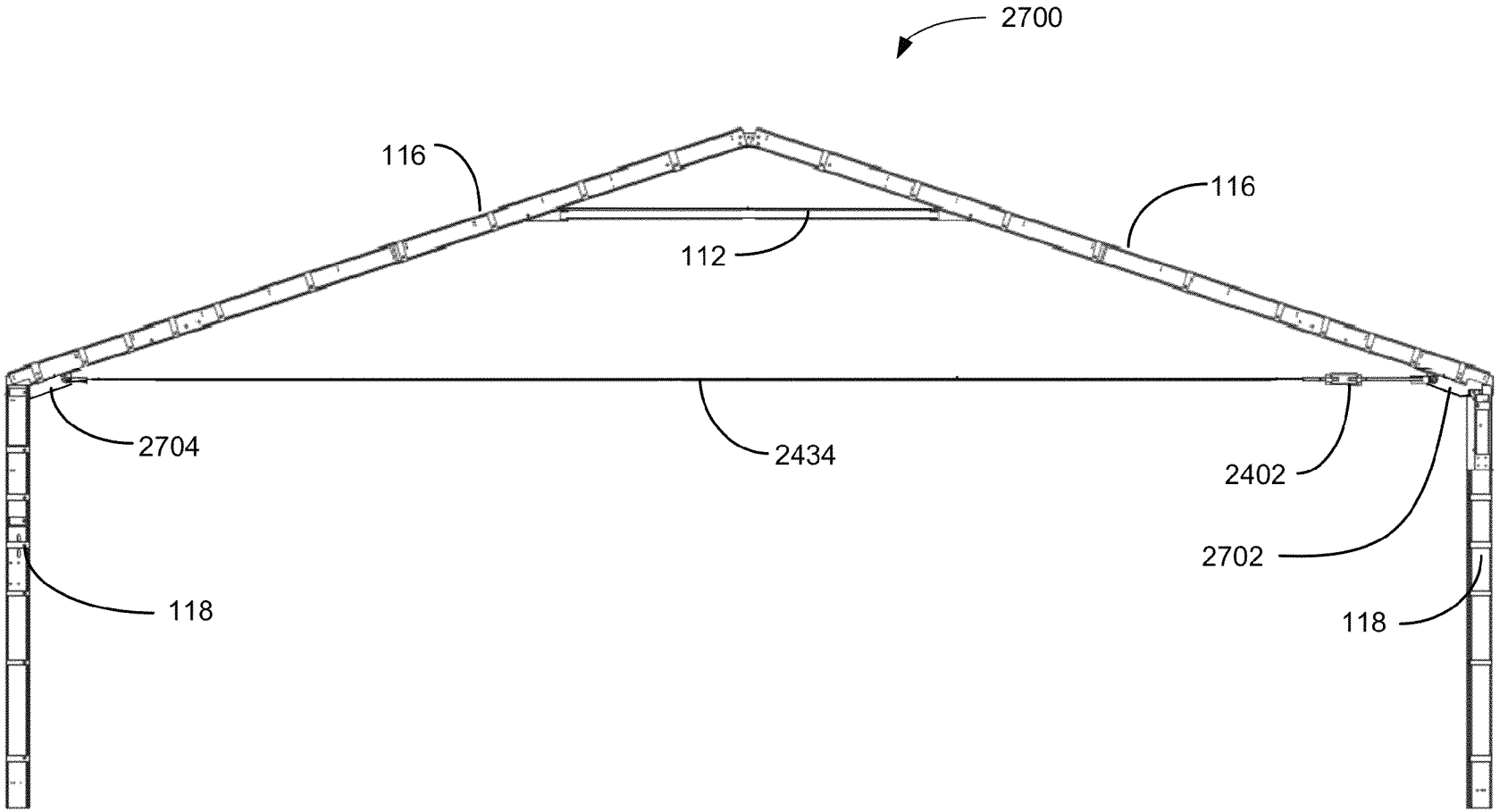
FIG. 27 is a front elevation view illustrating a second exemplary tension cable and turnbuckle installed in a second exemplary section of an improved folding building system, according to a preferred embodiment of the present invention.

FIG. 27 is a front elevation view illustrating an exemplary embodiment 2700 of a second exemplary tension cable 2434 and turnbuckle 2402 installed in a second exemplary section 100 of an improved folding building system, according to a preferred embodiment of the present invention. The second embodiment uses attachment plates 2702 and 2704 that attach only to the rafter 116 near the column/rafter corner and so can be installed at the factory and fit inside the folded section 100 for shipment.

Figure 28:
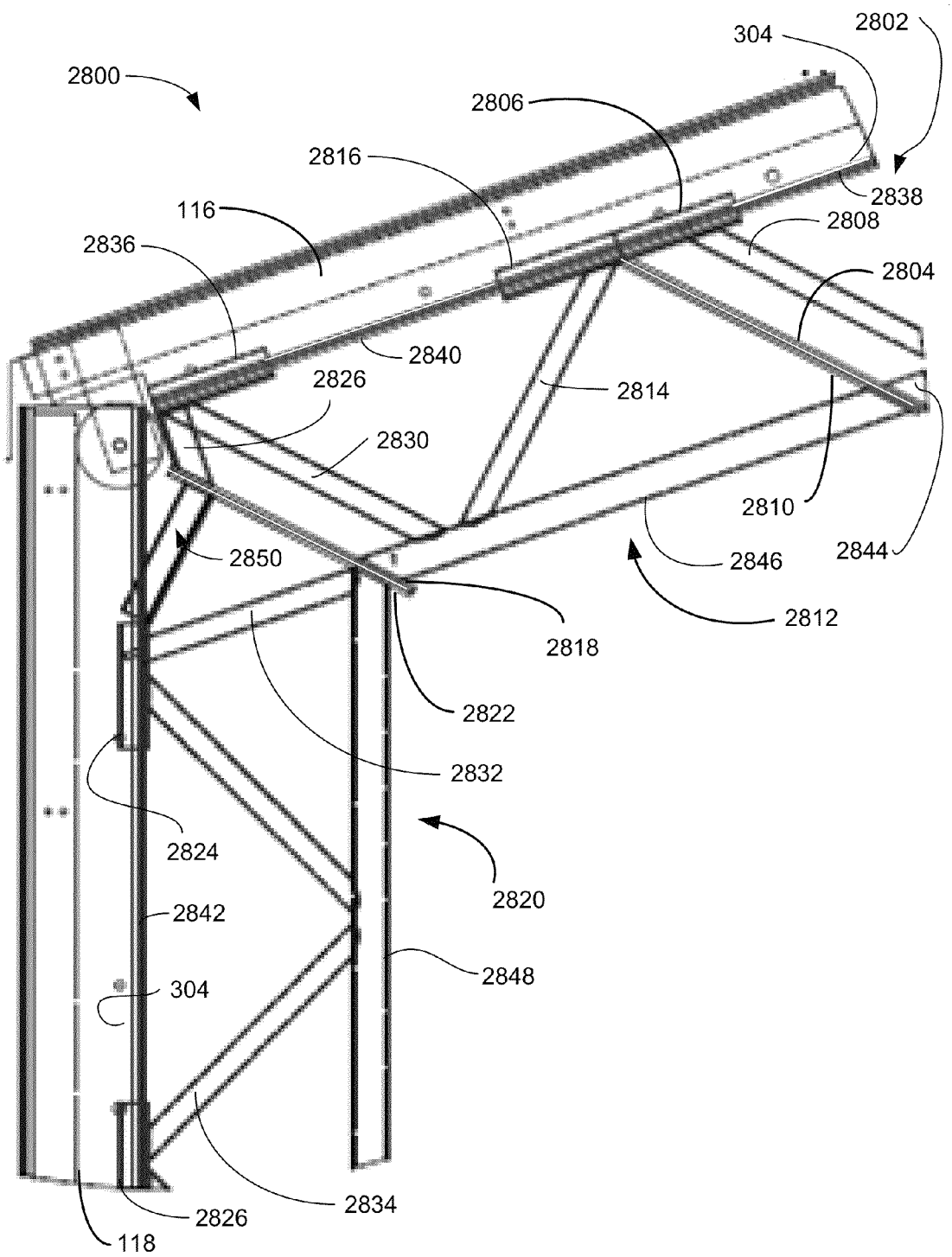
FIG. 28 is a front elevation view illustrating an exemplary lattice span in an exemplary section of an improved folding building system, according to a preferred embodiment of the present invention.

FIG. 28 is a front elevation view illustrating an exemplary lattice span truss 2800 in an exemplary section 100 of an improved folding building system, according to a preferred embodiment of the present invention. The lattice span truss 2800 is primarily for buildings that are seventy feet wide or wider, or buildings that require extra strength to resist environmental loads. The columns 118 are of the same height as in previously described embodiments, but the rafters 116 are appropriately longer to make the building width as required for a particular installation. The lattice span truss 2800 includes three incrementally deployable trusses 2802, 2812, and 2820 joined using fastened (not shown) abutment plates 2804 and 2810 as well as 2818 and 2822. The first truss 2802 (best seen in FIG. 29) is hingingly coupled to the rafter 116 such that it is folded within the stack for shipment and swings down on hinges 2806, aligned with the rafter 116, when deployed. The hinges 2806 are fastened to flange 304 of the rafter channel. First truss 2802 includes lower beam 2844, a plurality of triangular braces 2808 forming the truss 2802 with the hinge points 2806 and the lower beam 2844. Truss 2802 has a first abutment plate 2804 on a truss end proximal the column 118 and a second abutment plate 2902 proximal the ridge plate 110 (see FIG. 29). First abutment plate 2804 is affixed to and between hinge 2806 and beam 2844.

The second truss 2812 includes lower beam 2846, braces 2814 affixed between the lower beam 2846 and hinges 2816 and 2836. Second truss 2812 is folded within the stack for shipment and swings down on hinges 2816 and 2836, aligned with the rafter 116, when deployed. Second truss 2812 also includes distal abutment plate 2810 and proximal abutment plate 2818. Distal abutment plate 2810 abuts the first abutment plate 2804 of the first truss 2802 and is fastened thereto during deployment. Proximal abutment plate 2818 is supported by extension 2826. The hinges 2806 and 2816 with 2836 for the first and second trusses 2802 and 2812, respectively, are independent, so that the second truss 2812 can be swung into deployed position independently of the first truss 2802.

The third truss 2820 includes a beam 2848 and braces 2834 between the beam 2848 and hinges 2824 and 2826 to form third truss 2820. Third truss 2820 is hinged to column 118 and is deployed independently of first and second trusses 2802 and 2812. Third truss 2820 has an abutment plate 2822 attached to and between first beam 2848, truss support 2832, and a truncated brace 2850. Third truss abutment plate 2822 abuts and is fastened to second truss proximal abutment plate 2818, when deployed.

Figure 29:
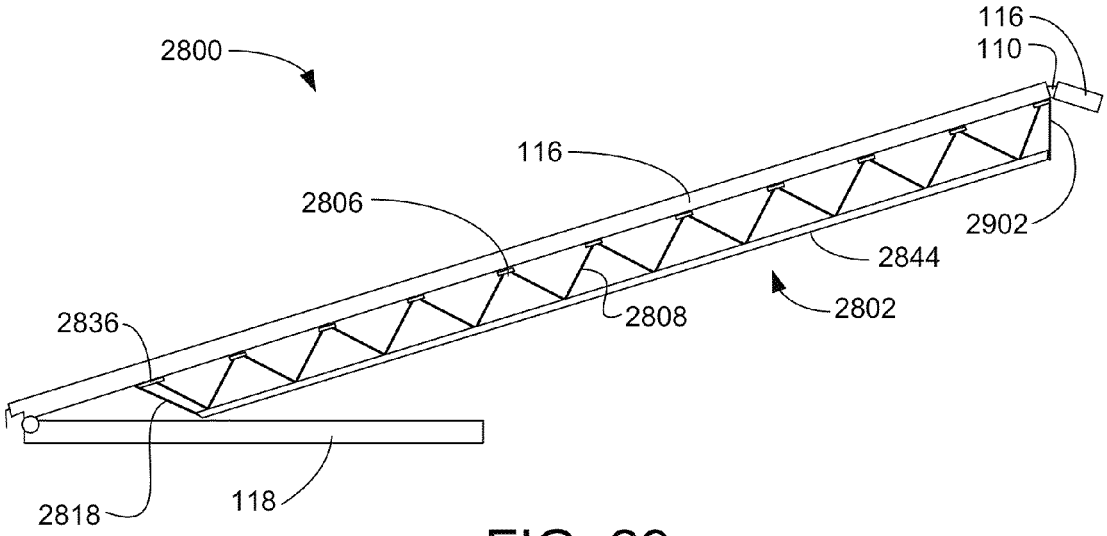
FIG. 29 is a front elevation view illustrating the exemplary lattice span of FIG. 28 in a first exemplary step of erecting an exemplary section of an improved folding building system, according to a preferred embodiment of the present invention.

FIG. 29 is a front elevation view illustrating the exemplary lattice span truss 2800 of FIG. 28 in a first exemplary step of erecting an exemplary section 100 of an improved folding building system, according to a preferred embodiment of the present invention. The section 100, slightly more than half of which is shown, is lifted by the ridge plate 110 until there is clearance to fold down the first truss 2802 to the position shown. The right half of the section 100, as shown n the drawing, is a mirror image of the left half. The second abutment plate 2902 will ultimately abut the second abutment plate 2902 for the right side of the section 100. Once deployed, first truss locks into position, adding strength to rafter 116. Deployment of first trusses takes place concurrently on the left and right sides of section 100. Second abutment plates 2902 of the left and right halves of section 100 are abutted and fastened together, and the section 100 is fastened to the pad 2050.

Figure 30:
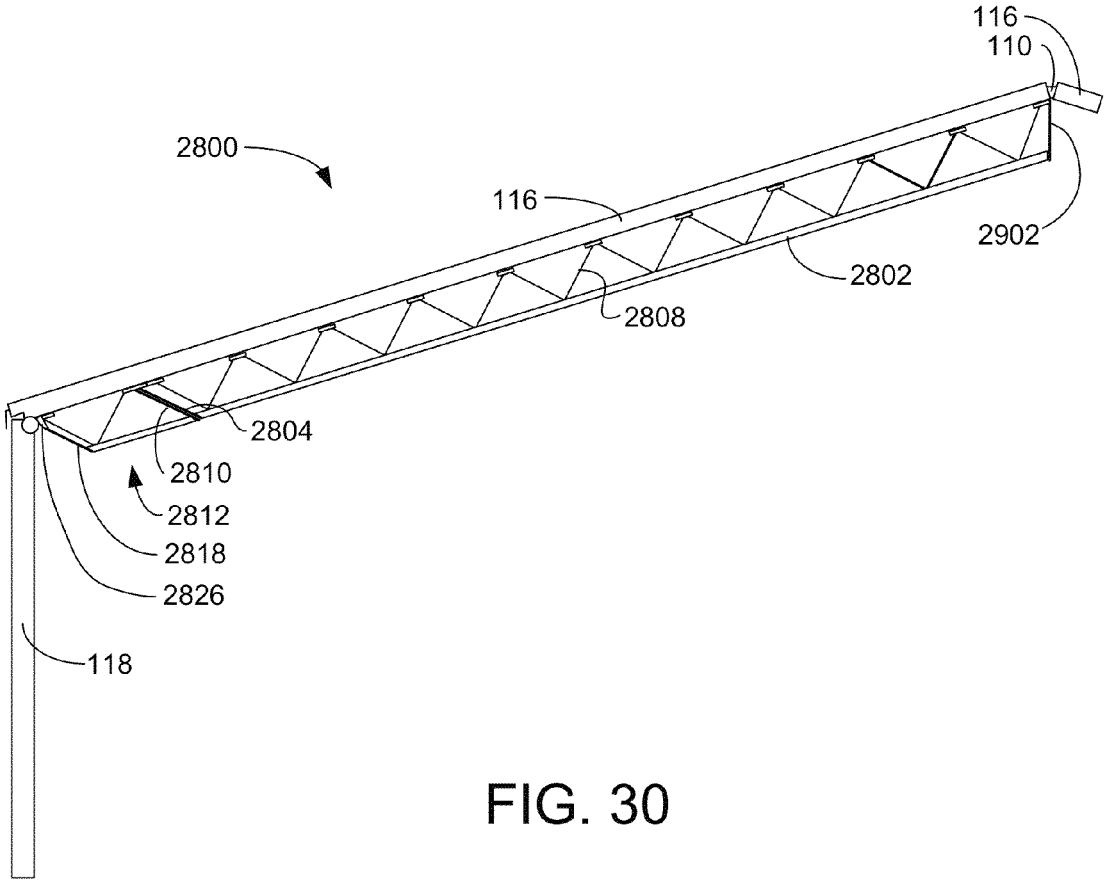
FIG. 30 is a front elevation view illustrating the exemplary lattice span of FIG. 28 in a second exemplary step of erecting an exemplary section of an improved folding building system, according to a preferred embodiment of the present invention.

FIG. 30 is a front elevation view illustrating the exemplary lattice span truss 2800 of FIG. 28 in a second exemplary step of erecting an exemplary section 100 of an improved folding building system, according to a preferred embodiment of the present invention. Using the improved strength to the rafters 116, rafters 116 are lifted by crane using attachments points on the rafters 116 similar to those shown in FIG. 20H. The lift continues until the columns 118 are vertical, at which time the second truss 2812 is deployed and locked into position. First truss first abutment plate 2804 is fastened to second truss distal abutment plate 2810.

Figure 31:
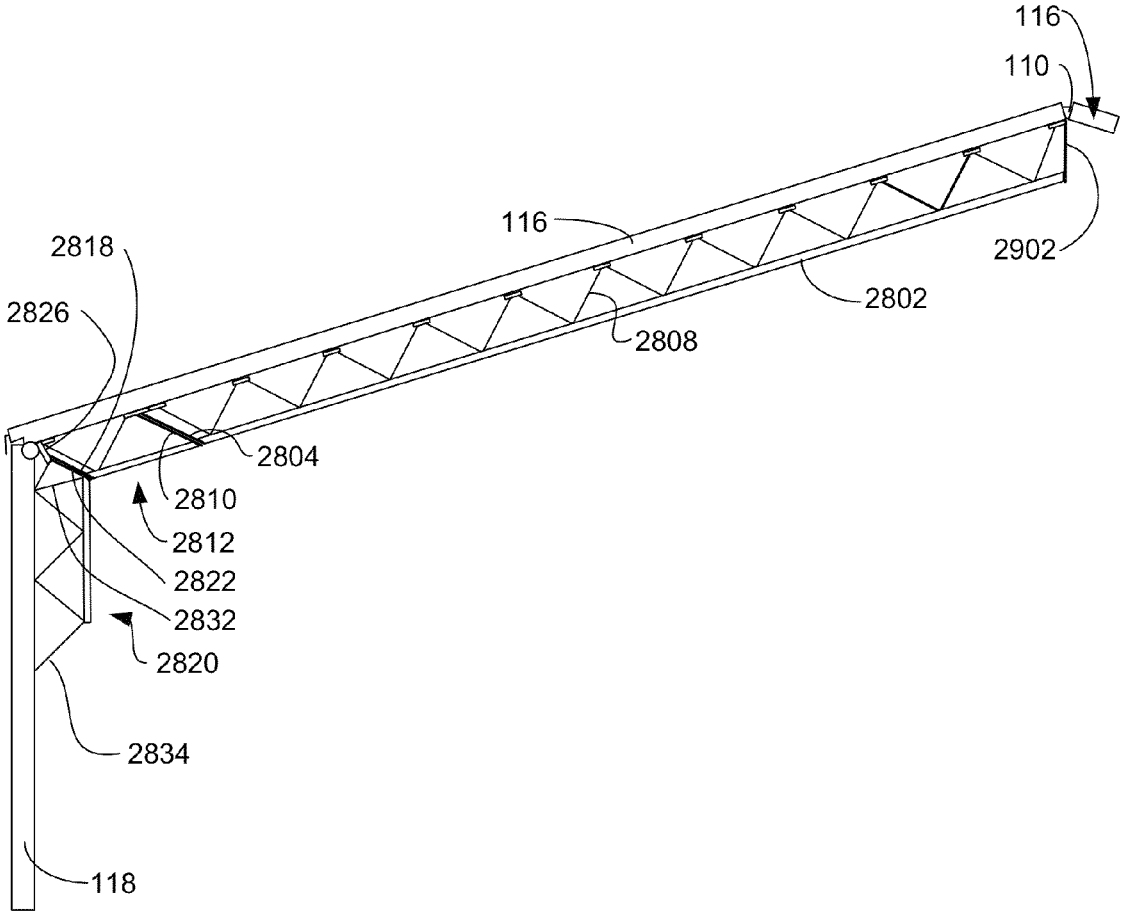
FIG. 31 is a front elevation view illustrating the exemplary lattice span of FIG. 28 in a third exemplary step of erecting an exemplary section of an improved folding building system, according to a preferred embodiment of the present invention.

FIG. 31 is a front elevation view illustrating the exemplary lattice span truss 2800 of FIG. 28 in a third exemplary step of erecting an exemplary section 100 of an improved folding building system, according to a preferred embodiment of the present invention. The correct angle between the column 118 and rafter 116 is established, and the third truss 2820 is deployed. Third truss abutment plate 2822 is abutted to and fastened to second truss proximal abutment plate 2818. In an additional embodiment, third truss 2820 may extend the entire length of column 118.

Figure 32:
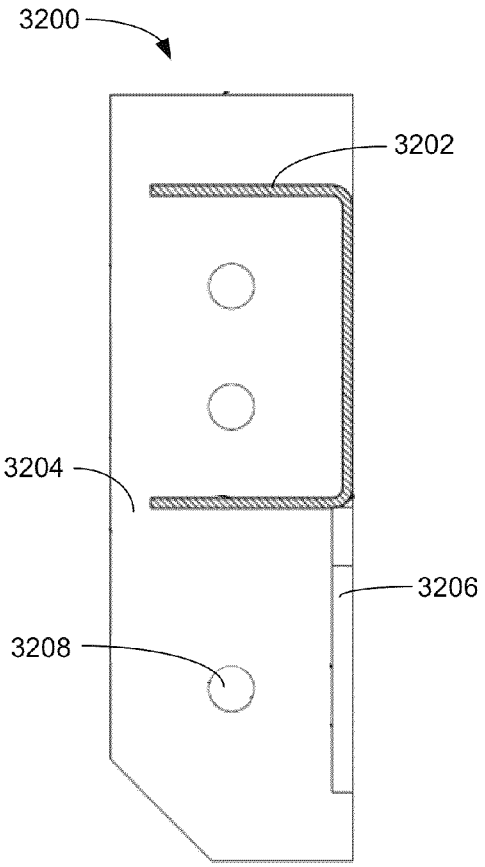
FIG. 32 is a cross sectional view illustrating an exemplary shipping brace assembly, according to a preferred embodiment of the present invention.

FIG. 32 is a cross sectional view illustrating an exemplary shipping brace assembly 3200, according to a preferred embodiment of the present invention. Shipping brace assembly 3200 includes girt 3202, which is a steel C-channel oriented to open inward to the building when installed. Girt 3202 is affixed, preferably welded, to plate 3204, which is preferably a steel plate. Girt 3202 is supported on girt plate by gusset 3206. Plate 3204 has bolt holes 3208 (one of three labeled) for fastening the girt plate to the web 302 of column 118 on the inner surface 402.

Figure 33:
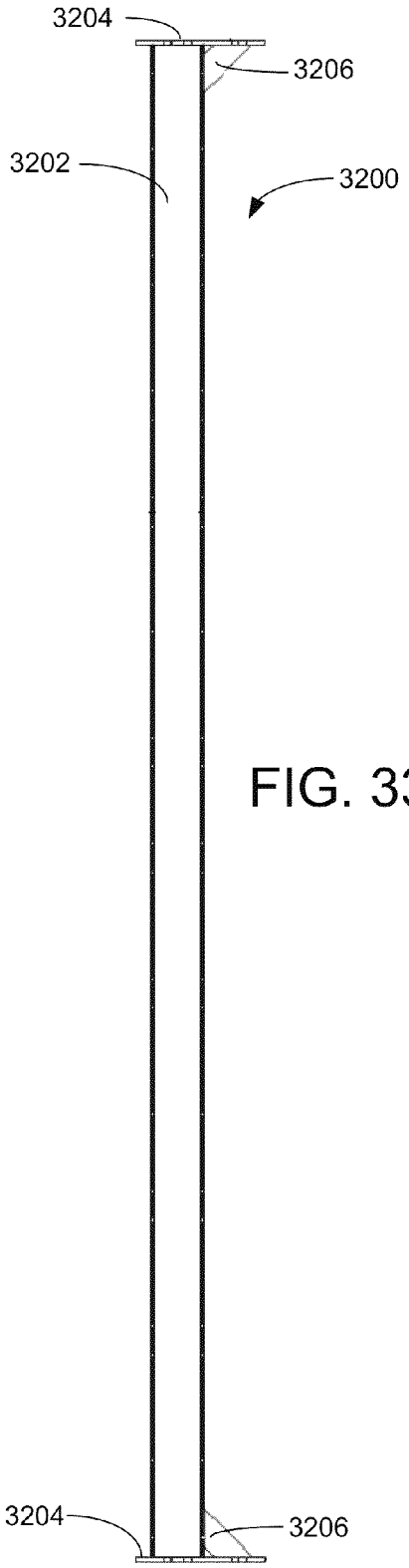
FIG. 33 is a rear elevation view illustrating the exemplary shipping brace assembly of FIG. 32, according to a preferred embodiment of the present invention.

FIG. 33 is a rear elevation view illustrating the exemplary shipping brace assembly 3200 of FIG. 32, according to a preferred embodiment of the present invention. Girt 3202 has a plate 3204 and a gusset 3206 at each end. The shipping brace assembly 3200 is sized to fit horizontally between opposing columns in a single wall panel 106 (see FIG. 6A), where two shipping brace assemblies 3200 replace two regular girts 502 in each wall panel 106 in embodiments requiring additional strength. Plates 3204 abut web surfaces 402 and are bolted to through holes in the web 302, which may be holes 404 and 204 (see FIG. 4).

Figure 34:
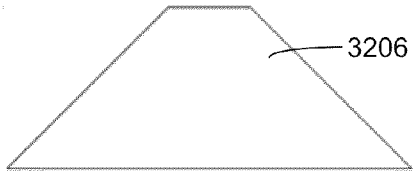
FIG. 34 is a front elevation view illustrating a gusset of the exemplary shipping brace assembly of FIG. 32, according to a preferred embodiment of the present invention.

FIG. 34 is a front elevation view illustrating a gusset 3206 of the exemplary shipping brace assembly 3200 of FIG. 32, according to a preferred embodiment of the present invention. Gusset 3206 is preferably steel plate and is preferably welded to and between plate 3204 and girt 3202. The shape of gusset 3206 is not a limitation of the invention.

Although applicant has described applicant's preferred embodiments of this invention, it will be understood that the broadest scope of this invention includes such modifications as diverse shapes and sizes and materials. Such scope is limited only by the above specification and the claims below.

Further, many other advantages of applicant's invention will be apparent to those skilled in the art from the above descriptions.

We claim:

1. An improved folding building system including deployable folded four-panel sections, said panels having sides further comprising outward-facing, spaced-apart, aligned, and opposed steel channels for rafters and for columns, wherein the improvement comprises:

a. a rafter plate having five holes operable to assist in joining first and second opposing rafters proximate a roof ridge, wherein:

i. first and second holes of said five holes are proximate a top of said rafter plate and at opposing ends of said rafter plate and are configured to receive fasteners during transportation, to operate as hinges during deployment, and to subsequently receive fasteners during deployment;

ii. third and fourth holes of said five holes are proximate a bottom of said rafter plate and at said opposing ends of said rafter plate and are configured to receive fasteners during deployment; and iii. a fifth hole of said five holes is proximate a top center of said rafter plate and configured for lifting during deployment and operable to receive safety lines during roof finishing;

iv. wherein all said five holes are mutually parallel; and b. first and second top corner side surfaces on said rafter plate configured to abut respective first and second rafter plate stops fixed to said first and second opposing rafters, when fully deployed.

2. The improved folding building system of claim 1, a further improvement including a rafter comprising:

a. a plurality of bracket plates attached on opposing flange edges transversely across the channel of said rafter; and b. a hole in each said bracket plate aligned to a respective hole in a web of said channel operable to receive fasteners operable to fasten adjacent said sections together.

3. The improved folding building system of claim 1, a further improvement including a rafter comprising:

a. a plurality of sets of holes in a web of said channel operable to receive fasteners to an equal or lesser plurality of L-brackets on an exterior surface of said web;

b. first and second holes in said web proximate a roof ridge end of said rafter, wherein said first and second holes are configured to receive fasteners to said rafter plate; and c. a wall coupling extending from a roof eave end of said rafter and configured to assist in fixing a relationship between said rafter and a column during transportation, in providing a pivot between said rafter and said column during deployment, and in fixing a relationship between said rafter and said column when a predetermined angular relationship is established.

4. The improved folding building system of claim 1, a further improvement including a rafter comprising:

a. at least one corner brace hole in a web proximate a roof eave end operable to assist in attaching a corner brace;

b. at least one ridge brace hole in said web proximate a roof ridge end operable to assist in attaching a ridge brace;

c. at least two cross brace flanges extending acutely from an exterior surface of said web operable to assist in attaching at least two cross braces within one said panel of said four panels.

5. The improved folding building system of claim 2, wherein said rafter comprises a lifting sleeve extending between opposed bored flanges of said channel and located proximate a middle of a length of said rafter.

6. The improved folding building system of claim 2, wherein said rafter comprises said rafter plate stop operable to abut one of said first and second top corner side surfaces of said rafter plate when fully deployed.

7. The improved folding building system of claim 3, a further improvement including a section comprising two roof panels of said four panels, each roof panel comprising:

a. first and second opposed said rafters forming said sides of said roof panel;

b. a plurality of steel stud purlins coupled between said rafters and coupled to said opposed rafters by said L-shaped brackets;

c. a corrugated metal sheet attached across exterior faces of said plurality of said steel stud purlins to form an exterior roof surface when deployed;

d. at least two cross braces coupled to at least two cross brace flanges and proximate to an indoor surface of said purlins;

e. a vapor barrier between said purlins and said corrugated metal sheet; and f. thermal insulation between said vapor barrier and said corrugated metal sheet.

8. The improved folding building system of claim 1, a further improvement including a column, the column comprising:

a. a plurality of bracket plates attached on opposing flange edges transversely across the channel of said column; and b. a hole in each said bracket plate aligned to a respective hole in a web of said channel operable to receive fasteners operable to fasten adjacent said sections together.

9. The improved folding building system of claim 1, a further improvement including a column, the column comprising:

a. a plurality of sets of holes in a web of said channel operable to receive fasteners operable to fasten a plurality of L-brackets on an exterior surface of said web;

b. at least one hole in said web proximate a roof eave end operable to assist in attaching a corner brace;

c. at least two cross brace flanges extending acutely from said exterior surface of said web; and d. a base plate closing a bottom end of said column, wherein said base plate has an extension with holes operable to assist in fastening a caster during deployment and to assist in fastening a wall panel of said four panels to a foundation.

10. The improved folding building system of claim 9, a further improvement including a section comprising two wall panels of said four panels, each wall panel comprising:

a. first and second opposed said columns forming said sides of said wall panel;

b. a plurality of steel stud girts coupled between said columns and coupled to said columns by said L-shaped brackets;

c. a first corrugated metal sheet attached across exterior faces of said plurality of said steel stud girts to form an exterior wall when deployed;

d. at least two cross braces coupled to said at least two cross brace flanges and proximate to indoor surfaces of said girts;

e. a vapor barrier between said girts and said first corrugated metal sheet;

f. thermal insulation between said vapor barrier and said first corrugated metal sheet; and g. a second corrugated metal sheet attached across interior faces of said plurality of said steel stud girts to form an interior wall when deployed.

11. The improved folding building system of claim 10, further comprising at least one shipping brace installed between first and second opposing columns of at least one said panel section.

12. The improved folding building system of claim 10, further comprising first and second tension cables, each said tension cable comprising:

a. a turnbuckle having a first threaded attachment to a rigid attachment to at least one of a first column, a first rafter, and a plate attached to at least one of said first column and said first rafter; and b. a tensionable cable having a first cable end coupled to a second threaded attachment to said turnbuckle and a second end attached to at least one of a second column, a second rafter, and a plate attached to at least one of said second column and said second rafter on an opposed side of said building.

13. The improved folding building system of claim 10, further comprising a lattice span truss spanning the junction of said rafter and an attached said column, and having at least three independent pieces that fold into said section during transport and storage and that deploy by unfolding during building erection, wherein each of the three pieces is deployed in turn and fastened to an adjacent piece.

14. The improved folding building system of claim 1, a further improvement including:

a. a plurality of said sections deployed, aligned, and fastened panel-side-to-panel-side to form a shell having a continuous wall and roof;

b. at least one end panel adapted to at least partially close an end of said shell;

c. a plurality of flashing strips having a lesser plurality of predetermined lengths and shapes, wherein said flashing strips comprise gauge steel with adhered closed-cell foam and wherein ridge flashing strips of said plurality of flashing strips further comprise interconnecting ends.

15. The improved folding building system of claim 14, a further improvement including said at least one of said four-panel section and said at least one end panel having one of a door frame, a window frame, and a skylight framed with at least two of a purlin, a girt, a column, and a rafter.

16. An improved folding building system including deployable folded four-panel sections having sides further comprising outward facing steel channels for rafters and columns, wherein the improvement comprises:

a. a rafter plate having five holes operable to assist in joining first and second opposing rafters proximate a roof ridge, wherein:

i. first and second holes of said five holes are proximate a top of said rafter plate and at opposing ends of said rafter plate and are configured to receive fasteners during transportation, to operate as hinges during deployment, and to receive fasteners at completion of deployment;

ii. third and fourth holes of said five holes are proximate a bottom of said rafter plate and at opposing ends of said rafter plate and are configured to receive fasteners at completion of deployment; and iii. a fifth hole of said five holes is proximate a top center of said rafter plate and configured for lifting during deployment and operable to receive safety lines during roof finishing;

iv. wherein all said five holes are mutually parallel; and b. first and second top corner side surfaces configured to abut respective first and second rafter plate stops fixed to said first and second opposing rafters, when deployed;

c. each rafter of said first and second opposing rafters further comprising:

i. a plurality of spaced apart bracket plates attached on opposing flange edges transversely across the channel of said rafter; and ii. a hole in each said bracket plate aligned to a respective hole in a web of said channel operable to receive fasteners operable to fasten adjacent said sections together.

17. The improved folding building system of claim 16, a further improvement including a rafter comprising:

a. a plurality of said bracket plates attached to opposing flange edges transversely across the channel of said rafter;

b. a hole in each said bracket plate aligned to a respective hole in said web of said channel operable to receive fasteners operable to fasten adjacent said sections together;

c. a plurality of sets of holes in said web operable to receive fasteners operable to fasten an equal or lesser plurality of L-shaped brackets on an exterior surface of said web;

d. first and second holes in said web proximate a roof ridge end of said rafter, wherein said first and second holes are configured to receive fasteners to said rafter plate;

e. a wall coupling extending from a roof eave end of said rafter and configured to assist in fixing the relationship between said rafter and a column during transportation, to provide a pivot between said rafter and said column during deployment, and to subsequently assist in fixing a relationship between said rafter and said column during deployment;

f. at least one corner brace hole in said web proximate said roof eave end operable to assist in fastening a corner brace;

g. at least one ridge brace hole in said web proximate said roof ridge end, said at least one ridge brace hole operable to assist in fastening a ridge brace;

h. at least two cross brace flanges extending acutely from said exterior surface of said web operable to be attached to at least two cross braces within each said panel of said four panels; and i. a lifting sleeve between bored flanges of said channel and located proximate a middle of a length of said rafter.

18. The improved folding building system of claim 17, a further improvement including two roof panels of said four panels, each roof panel comprising:

a. first and second opposed said rafters forming said sides of said roof panel;

b. a plurality of steel stud purlins coupled between said rafters and coupled to said opposed rafters by said L-shaped brackets;

c. a corrugated metal sheet attached across exterior surfaces of said plurality of said steel stud purlins to form an exterior roof surface when deployed;

d. at least two cross braces coupled to said at least two cross brace flanges and proximate to an indoor surface of said purlins;

e. a vapor barrier between said purlins and said corrugated metal sheet; and f. thermal insulation between said vapor barrier and said corrugated metal sheet.

19. The improved folding building system of claim 16, a further improvement including a column, the column comprising:

a. a plurality of said bracket plates attached on opposing flange edges transversely across the channel of said column;

b. a hole in each said bracket plate aligned to a respective hole in said web of said channel operable to receive fasteners operable to fasten adjacent said sections together;

c. a plurality of sets of holes in said web operable to receive fasteners operable to fasten a plurality of L-shaped brackets on an exterior surface of said web;

d. at least one hole in said web proximate a roof eave end operable to assist in attaching a corner brace;

e. at least two cross brace flanges extending acutely from said exterior surface of said web; and f. a base plate closing a bottom end of said column, wherein said base plate has an extension with holes operable to assist in fastening a caster during deployment and subsequently to assist in fastening a wall panel of said four panels to a foundation.

20. The improved folding building system of claim 19, a further improvement including two wall panels of said four panels, each wall panel comprising:

a. first and second opposed said columns forming said sides of said wall panel;

b. a plurality of steel stud girts coupled between said columns and coupled to said columns by said L-shaped brackets;

c. a first corrugated metal sheet attached across exterior faces of said plurality of said steel stud girts to form an exterior wall when deployed;

d. at least two cross braces coupled to said at least two cross brace flanges and proximate to indoor surfaces of said girts;

e. a vapor barrier between said girts and said first corrugated metal sheet;

f. thermal insulation between said vapor barrier and said first corrugated metal sheet; and g. a second corrugated metal sheet attached across said first and second opposed said columns to form an interior wall when deployed.

21. The improved folding building system of claim 16, a further improvement including:

a. a plurality of said sections deployed, aligned, and fastened panel-side-to-panel-side to form a shell having a continuous wall and roof;

b. at least one end panel adapted to at least partially close an end of said shell;

c. a plurality of flashing strips having a lesser plurality of predetermined lengths and shapes, wherein said flashing strips comprise gauge steel with adhered closed-cell foam rubber and wherein ridge flashing strips of said plurality of flashing strips further comprise interlocking ends.

22. A method of deploying an improved folding building system including deployable stacked four-panel sections, said panels having opposing sides further comprising outward-facing spaced-apart, aligned, and opposed steel channels for rafters and for columns and wherein said rafters are longer than said columns, the method comprising the steps of:

a. delivering a folded and fastened together said four-panel section to an assembly area having a foundation, wherein said stack rests on a first wall panel;

b. unfastening shipping fasteners from said section;

c. unfolding said stack about pivot points between first and second loosely fastened ridge plates and first and second roof panels, wherein said unfolded stack rests on said first and a second wall panel;

d. lifting said first and second adjacent said roof panels via lifting points in said first and second ridge plates, until a desired roof angle is obtained;

e. fastening first and second ridge braces between said first and second roof panels;

f. installing first and second casters on first and second base plate extensions, respectively, on each bottom edge of said two wall panels of said four-panel section;

g. additionally lifting said first and second roof panels to a position in which first, second, third and fourth corner braces can be initially and pivotably installed;

h. installing said corner braces;

i. further lifting said section until said wall panels are vertical;

j. removing said casters;

k. fixing cross braces in place;

l. aligning said first wall panel to said foundation;

m. attaching said first wall panel to said foundation via said first and second base plate extensions of said first wall panel;

n. relaxing lift;

o. attaching said second wall panel to said foundation via said first and second base plate extensions of said second wall panel;

p. complete ridge plate fastening;

q. repeating steps a-p to deploy a plurality of said sections;

r. fastening said plurality of sections together along panel sides to form a shell with continuous walls and roof;

s. attaching at least one end panel to at least partially close off at least one end of said shell;

t. flashing seams between said panels using a gauge steel flashing with adhered closed-cell foam rubber of custom lengths.

23. A method of deploying an improved folding building system including deployable stacked four-panel sections, said panels having opposing sides further comprising outward-facing spaced-apart, aligned, and opposed steel channels for rafters and for columns and wherein said columns are longer than said rafters, the method comprising the steps of:

a. delivering said stacked four-panel section, fastened together with shipping fasteners, to an assembly area having a foundation, and unfastening shipping fasteners from first and second wall panels and first and second roof panels of said four-panel section;

b. disposing said first roof panel on said foundation and aligning said second roof panel to said first roof panel;

c. supporting said first and second roof panels in an elevated and linearly aligned position;

d. attaching a first five-hole rafter plate to a ridge end of said first rafter of said first roof panel using one fastener through a top, first-side bore in said first rafter plate;

e. attaching a second five-hole rafter plate to a ridge end of said second rafter of said first roof panel using one fastener through a top, first-side bore in said second rafter plate;

f. pivotably attaching said first and second rafter plates to respective first and second rafters of said second roof panel;

g. linearly aligning said first and second wall panels to said first and second roof panels, respectively;

h. aligning first and second eave-end pivotable rafter coupling portions of said first and second roof panels to first and second top-end pivotable column coupling portions, respectively, of said first and second wall panels and installing four pivot fasteners through said four coupling portions, respectively, to form a first and second roof-to-wall couplings, respectively;

i. attaching first and second casters to first and second base plate extensions of each said first and second wall panels;

j. attaching first and second hoisting bars via cables to first and second swivel hoist rings installed proximate the top end of said first and second columns, respectively, of each of said first and second wall panels;

k. lifting said first and second wall panels until a predetermined corner angle between said first wall panel and said first roof panel is achieved and, in turn, said predetermined angle between said second wall panel and said second roof panel is achieved;

l. installing first and second corner braces between said first wall panel and said first roof panel to maintain said predetermined angle;

m. installing third and fourth corner braces between said second wall panel and said second roof panel to maintain said predetermined angle;

n. disconnect said first and second hoisting bars and said swivel hoist rings;

o. attach a hoisting bar via four cables to four respective long shank hoist rings in four respective lifting sleeves in four respective said rafters;

p. lifting said section via said hoisting bar until a predetermined roof ridge angle is achieved;

q. fastening a first ridge brace between said first pivotably coupled pair of rafters to assist in maintaining said predetermined roof ridge angle;

r. fastening a second ridge brace between said second pivotably coupled pair of rafters to assist in maintaining said predetermined roof ridge angle;

s. installing additional fasteners to secure said rafter plates to said rafters, and tightening all rafter plate fasteners;

t. removing said casters;

u. orienting said section on said foundation and securing said section to said foundation via fasteners through said base plate extensions;

v. repeating steps a-u for at least one additional said sections;

w. aligning and fastening together a plurality of said sections by fastening adjacent said rafters and adjacent said columns to form a shell;

x. installing at least one end panel to close off at least a portion of at least one end of said shell;

y. flashing seams between said panels using a gauge steel flashing with adhered closed-cell foam rubber.

* * * * *